US008292546B2

(12) United States Patent
Wu

(10) Patent No.: US 8,292,546 B2
(45) Date of Patent: Oct. 23, 2012

(54) LIQUID STORAGE, LOADING AND OFFLOADING SYSTEM

(76) Inventor: Zhirong Wu, Beijing (CN)

( * ) Notice: Subject to any disclaimer, the term of this patent is extended or adjusted under 35 U.S.C. 154(b) by 0 days.

(21) Appl. No.: 12/890,495

(22) Filed: Sep. 24, 2010

(65) Prior Publication Data

US 2011/0013989 A1 Jan. 20, 2011

Related U.S. Application Data

(63) Continuation of application No. PCT/CN2009/000320, filed on Mar. 26, 2009.

(30) Foreign Application Priority Data

Mar. 26, 2008 (CN) ..... 2008 1 0024562
Mar. 26, 2008 (CN) ..... 2008 1 0024563
Mar. 26, 2008 (CN) ..... 2008 1 0024564
Sep. 5, 2008 (CN) ..... 2008 1 0196338

(51) Int. Cl.
*B63B 35/44* (2006.01)

(52) U.S. Cl. ..... 405/210; 405/224

(58) Field of Classification Search ..... 405/195.1, 405/205, 207, 208, 209, 210, 224
See application file for complete search history.

(56) References Cited

U.S. PATENT DOCUMENTS 2,990,796 A * 7/1961 Cole et al. ..... 405/210
3,307,512 A * 3/1967 Fell ..... 114/74 R
3,472,032 A * 10/1969 Howard ..... 405/210
3,572,278 A * 3/1971 Knapp et al. ..... 405/210
3,656,307 A * 4/1972 Mott ..... 405/210
3,828,565 A * 8/1974 McCabe ..... 405/210
3,855,809 A 12/1974 Westling
3,898,846 A * 8/1975 McCabe ..... 405/210
3,913,335 A * 10/1975 Heien ..... 405/210
3,961,488 A 6/1976 Ovsttun
4,060,335 A 11/1977 Holloway et al.
4,060,995 A 12/1977 Lacroix
4,155,671 A * 5/1979 Vos ..... 405/210
4,188,157 A * 2/1980 Vigander ..... 405/210
4,195,951 A 4/1980 Finsterwalder
4,200,411 A 4/1980 Brown et al.
4,217,848 A * 8/1980 Meyer-Haake ..... 405/210
4,232,983 A * 11/1980 Cook et al. ..... 405/210
(Continued)

FOREIGN PATENT DOCUMENTS

CN 1285442 A 2/2001
(Continued)

*Primary Examiner* — Frederick L Lagman
(74) *Attorney, Agent, or Firm* — Lai, Corsini & Lapus, LLC

(57) ABSTRACT

A liquid storage, loading and offloading system includes a storage tank having a water ballast compartment for storing water and a liquid storage compartment for storing liquid. The water ballast compartment and the liquid storage compartment are coupled to each other to form a closed interconnected system with pressurized inert gas above water and liquid. The storage tank is configured symmetrically and the center of gravity and buoyancy of it move along a vertical Z axis. Besides, a pump module may also be included and have a pair of loading pumps and a pair of offloading pumps. The pair of loading pumps operates substantially at equal mass flow rate to displace water with liquid. The pair of offloading pumps also operates substantially at equal mass flow rate to displace liquid with water. Therefore an equal mass flow rate displacement system is formed to keep a constant draft.

36 Claims, 22 Drawing Sheets

U.S. PATENT DOCUMENTS

| | | | | |
|---|---|---|---|---|
| 4,351,623 | A * | 9/1982 | Heinz et al. | 405/210 |
| 4,365,576 | A * | 12/1982 | Cook | 405/210 |
| 4,402,632 | A * | 9/1983 | Cook | 405/210 |
| 4,422,803 | A * | 12/1983 | Wetmore | 405/210 |
| 4,433,940 | A * | 2/1984 | Harrison | 405/210 |
| 4,556,343 | A * | 12/1985 | Cheung | 405/210 |
| 4,685,833 | A * | 8/1987 | Iwamoto | 405/210 |
| 4,766,836 | A | 8/1988 | Behar et al. | |
| 5,885,028 | A | 3/1999 | Blanchard et al. | |
| 5,899,637 | A | 5/1999 | Blanchard et al. | |
| 6,390,733 | B1 * | 5/2002 | Burbage et al. | 405/203 |
| 6,415,828 | B1 | 7/2002 | Duggal et al. | |
| 6,817,809 | B2 | 11/2004 | Choi et al. | |
| 7,735,506 | B2 * | 6/2010 | Horton et al. | 405/210 |
| 2004/0259961 | A1 * | 12/2004 | O'Rear | 410/156 |
| 2005/0163572 | A1 * | 7/2005 | Keron | 405/210 |
| 2006/0243184 | A1 * | 11/2006 | O'Rear | 114/121 |
| 2006/0243950 | A1 * | 11/2006 | O'Rear | 252/372 |
| 2007/0140795 | A1 * | 6/2007 | Espinasse | 405/210 |
| 2011/0146803 | A1 | 6/2011 | Wu | |

FOREIGN PATENT DOCUMENTS

| | | | |
|---|---|---|---|
| CN | 1646362 | A | 7/2005 |
| CN | 200810196337.9 | | 3/2010 |
| GB | 2216849 | | 10/1989 |
| JP | 10250677 | A * | 9/1998 |
| JP | 11-115887 | | 4/1999 |
| WO | WO95/19472 | | 7/1995 |
| WO | WO2007119051 | | 10/2007 |
| WO | WO/2010/025625 | | 3/2010 |

* cited by examiner

LIQUID STORAGE, LOADING AND OFFLOADING SYSTEM

CROSS-REFERENCE TO RELATED APPLICATION(S)

The present invention is a continuation of International Application PCT/CN2009/000320 filed on Mar. 26, 2009, now published in Chinese as WO/2009/117901, which claims the benefit of CN200810024564.3, CN200810024562.4, and CN 200810024563.9 filed on Mar. 26, 2008, and CN200810196338.3 filed on Sep. 5, 2008, all of which are hereby incorporated by reference in their entireties.

FIELD OF THE INVENTION

The present invention relates to the field of a liquid storage, loading and offloading system. More particularly, the present invention relates to the field of a loading and offloading system, including liquid storage apparatus, which is used as an offshore terminal underwater or at the water surface and able to be applied with offshore oil drilling and production facilities.

BACKGROUND OF THE INVENTION

This section provides background information related to the present disclosure which is not necessarily prior art.

Storage, loading, and offloading of crude oil or other hydrocarbon liquids are crucial issues for the oil production industry. Theses issues decide the facility selection for the oilfield development and make great impacts on the money investment, operational cost, and business interests.

There are two major methods to store crude oil or other hydrocarbon liquids. The first method is called "wet storage" or "water pillow storage." In this method, the oil and seawater are stored together in a same tank. Because of the density difference between oil and seawater, the oil rises to the top of the tank. While the wet storage is adopted with a loading and offloading system, incoming oil displaces an equal volume of existing seawater to keep constant total volume of oil and seawater in the tank, and vice versa.

The wet storage could be applied with a gravity platform sitting on the seabed or a floating platform with underwater oil storage. If the wet storage is applied with a floating platform, an automatic water-adjusting system for maintaining constant total mass is additionally necessary. Great efforts have been made in floating platforms with underwater oil storage during the development of oilfield in the deep sea, such as SPAR platforms with underwater pontoons to store oil or BOX-SPAR concepts.

The second method is called "dry storage." In this method, oil are stored with inert gas, which is controlled by an inert gas generating, blanketing, and venting system, in order to prevent any exchange of air between inner and outside environment. While the dry storage is adopted with loading and offloading system, the change of oil mass is compensated by the adjustment of the seawater ballast in a different tank that is not fluidly connected to the tank that holds the oil.

The dry storage could be applied with a gravity platform or a floating platform with oil storage. The floating platform at the water surface usually adopts the dry storage to store oil in the ship, such as a ship-shaped FPSO (Floating Production Storage Offloading Unit), a ship-shaped FSO (Floating Storage Offloading), or a SSP (Sevan Stabilized Platform). The floating platform with underwater oil storage may adopt an improved dry storage. In the improved dry storage method, the solution for maintaining constant total mass is to keep the same mass flow rate of oil and seawater. Again, the tank that holds the oil and the tank that holds seawater are not fluidly connected.

There are only two matured storage methods in the above description: dry storage applied with a floating platform at the water surface and wet storage applied with a gravity platform. Each method has its own advantages and disadvantages.

The dry storage applied with a floating platform at the water surface could be greatly impacted by environmental conditions. For example, FPSO/FSO needs a strong mooring system for preventing large variation in environmental conditions. Besides, the required inert gas generating, blanketing, and venting system for the dry storage could cause pollution of oil gas emission. Furthermore, the tank needs to be designed specially with higher cost, because the pressure within the inert gas tank is lower than the seawater pressure.

The wet storage has four major disadvantages as follows.

First, the direct contact between oil and seawater results in a pollution problem. Second, the density difference between oil and seawater makes the weight of the whole system continuously change during loading and offloading operations through equal volume replacement in the storage. If an effective mass of storage is one hundred thousand tons, the weight difference of the whole system could reach ten thousand tons. Therefore, for being applied with a gravity platform, to increase ballast is required to make sure the storage is fixed on the seabed. For being applied with a floating platform, to maintain constant total mass by automatically adjusting water ballast is necessary.

Third, the wet method can only be used for storing water-insoluble liquid products, such as crude oil, rather than a water-soluble liquid, such as methanol. Fourth, heating oil in the storage is difficult because the interface between oil and water is changing.

Besides, the gravity platform has two further disadvantages as follows.

First, the foundation for the storage applied with a gravity platform is selective. Therefore, some seabed can't be used in the gravity platform development. Second, a gravity platform usually needs to be permanently fixed with solid ballast onto the seabed. Therefore, the gravity platform can't float up, move, and be reused in other oilfields at the end of oil production.

Currently, the most common floating platforms for oil/hydrocarbon production include TLP, SPAR, and sub-submersible (SEMI) platforms. However, they usually can't store oil/hydrocarbon in the platforms. FPSO and SSP usually can't have dry well mouth and be applied with oil drilling facility.

SUMMARY OF THE INVENTION

This section provides a general summary of the disclosure, and is not a comprehensive disclosure of its full scope or its entire feature. In one preferred embodiment, a liquid storage, loading and offloading system comprises a storage tank comprising at least one water ballast compartment for storing water, at least one liquid storage compartment for storing liquid and a volume of inert gas. The water ballast compartment and the liquid storage compartment are coupled to each other to form a closed interconnected system with inert gas above the water and liquid. The structure of the storage tank is configured symmetrically and the center of gravity and buoyancy of it move along a vertical line (hereinafter Z axis) parallel to the direction of the earth's gravitational pull.

In some embodiments, a liquid storage, loading and offloading system further comprises a valve, and a channel fluidly connecting the water ballast compartment and the liquid storage compartment. The valve can open the channel under normal operation and therefore allowing fluid connection between the water ballast compartment and the liquid storage compartment. As a result, the two compartments become a closed interconnected system. The valve can also close the channel under an abnormal condition and therefore the water ballast compartment and the liquid storage compartment become two different systems for prevention of liquid leakage. As a result, the two compartments are not fluidly connected.

In other embodiments, a liquid storage, loading and offloading system further comprises a pump module coupled to the storage tank. The pump module comprises at least one pair of loading pumps and at least one pair of offloading pumps. The pair of loading pumps includes a liquid loading pump for loading liquid into the liquid storage compartment and a water offloading pump for offloading water out of the water ballast compartment. The pair of offloading pumps includes a water loading pump for loading water into the water ballast compartment and a liquid offloading pump for offloading liquid out of the liquid storage compartment.

In still other embodiments, the pair of loading pumps operates substantially at equal mass flow rate to displace water with liquid. The pair of offloading pumps also operates substantially at equal mass flow rate to displace liquid with water. Therefore an equal mass flow rate displacement system is formed to keep a constant operating weight.

In still other embodiments, the water offloading pump for offloading water or the liquid offloading pump for offloading liquid can be replaced by pressure energy of inert gas in the water ballast compartment or the liquid storage compartment to discharge the water or liquid out. In still some embodiments, a liquid storage, loading and offloading system further comprises a converting valve coupled to the pump module for converting offloaded liquid to different locations.

In still other embodiments, a liquid storage, loading and offloading system further comprises a mooring system for receiving offloaded liquid from the storage tank or transmitting liquid to the storage tank. The mooring system is coupled to the storage tank by a riser. In still some embodiments, a liquid storage, loading and offloading system further comprises a working station for providing power and control. The working station is coupled to the storage tank by a cable.

In still other embodiments, a liquid storage, loading and offloading system further comprises a hydrocarbon production facility coupled to the storage tank by a pipeline. In still other embodiment, a liquid storage, loading and offloading system further comprises a fixing device attached to the storage tank for fixing the storage tank on the seabed. In still other embodiment, a liquid storage, loading and offloading system further comprises a mooring positioning system attached to the storage tank for mooring the storage tank on the seabed in a floating condition.

In still other embodiments, a liquid storage, loading and offloading system further comprises solid ballast adjacent to the storage tank for increasing weights and damping, and for lowering the center of weight. The diameter of the solid ballast is equal to or larger than the diameter of the storage tank. In still other embodiments, the liquid storage compartment is located inside of the water ballast compartment to form a tank-in-tank type of the storage tank. The central axis of the liquid storage compartment and the water ballast compartment are overlapped or parallel to each other. If multiple storage tanks exist, they are arranged in symmetry.

In still other embodiments, the liquid storage compartment is adjacent to the water ballast compartment, either horizontally or vertically, to form a not tank-in-tank type of the storage tank. If multiple storage tanks exist, they are arranged in symmetry and positioned with distance between them or head-to-tail vertically or horizontally. The lower storage tank has higher pressure of inert gas inside. In still other embodiment, if multiple water ballast compartments or multiple liquid storage compartments exist, they can be connected by a conduit respectively to become one water ballast compartment or one liquid storage compartment in substance. In still other embodiment, the inert gas is nitrogen.

In still other embodiments, the storage tank is formed as a foundation of a bottom-supported platform. In still other embodiments, a liquid storage, loading and offloading system further comprises a topside facility for hydrocarbon production and a platform leg. The platform leg is attached to the top of the storage tank. The topside facility is connected to the platform leg. Hydrocarbon production generated by the topside facility can be stored directly in the storage tank.

In still other embodiments, a liquid storage, loading and offloading system further comprises a moon pool for a riser or a conductor extending from an underground oil well to the topside facility.

In still other embodiments, a liquid storage, loading and offloading system further comprises a fixing device to fix the bottom-supported platform on seabed to form a bottom-supported and fixed platform. The weight of the bottom-supported and fixed platform at high water level is larger than the buoyancy of it, and therefore no large weight of the bottom-supported and fixed platform is required for stability. While liquid inside the fixed platform is drained up, the weight of the fixed platform at low water level is lighter than the buoyancy for removing and relocating. In still other embodiments, the bottom-supported and fixed system pierces the water surface or be near the water surface, and becomes a fixed artificial island.

In still other embodiments, a liquid storage, loading and offloading system further comprises a mooring positioning system to moor the bottom-supported platform in a floating condition to form a bottom-supported and floating platform. The center of gravity of bottom-supported and floating platform is lower than the center of buoyancy of it. The heaving period of the bottom-supported and floating platform is equal to or larger than 20 seconds. A constant operating weight of the bottom-supported and floating platform is kept.

In still other embodiments, a loading and offloading system further comprises a protecting shield above the storage tank for protecting any impact from outside environment and increasing weights and damping.

In still other embodiments, the bottom-supported and floating platform is sufficiently tall to pierce the water surface or be near the water surface, and becomes a floating artificial island.

In one preferred embodiment, a process of a loading and offloading system with equal mass flow rate displacement system comprises transporting a stored liquid or water from a bottom of a liquid storage compartment or a water ballast compartment to an inlet of a liquid offloading pump or a water offloading pump by a pressure energy of an inert gas, offloading the stored liquid or water by the respective offloading pump or only by the pressure energy of the inert gas and supplying the inert gas to maintain pressure of the inert gas of the liquid storage compartment or the water ballast compartment. The supplied inert gas is from the water ballast compartment which is loaded with water at the same mass flow rate as the offloaded liquid, or from the liquid storage compartment which is loaded with liquid at the same mass flow rate as the offloaded water.

In one preferred embodiment, a liquid storage, loading and offloading system comprises an artificial island comprising at least one water ballast compartment to store water and at least one liquid storage compartment to store liquid inside, a topside facility for hydrocarbon above the artificial island, and a volume of inert gas in the water ballast compartment and the liquid storage compartment. The hydrocarbon generated by the topside facility is stored directly in the artificial island.

In some embodiment, the water ballast compartment and the liquid storage compartment are coupled to each other form a closed interconnected system with the inert gas disposed above the water and liquid. In some embodiment, the structure of the artificial island is configured symmetrically. In some embodiment, the liquid storage, loading and offloading system further comprises a valve connected to the water ballast compartment and to the liquid storage compartment. The valve opens under a first condition and therefore the water ballast compartment and the liquid storage compartment become a closed interconnected system. The valve closes under a second condition and therefore the water ballast compartment and the liquid storage compartment become two separate systems not fluidly connected.

In other embodiments, the liquid storage, loading and offloading system further comprises a pump module coupled to the artificial island. The pump module comprises at least one pair of loading pumps and at lease one pair of offloading pumps. The pair of loading pumps includes a liquid loading pump to load the liquid into the liquid storage compartment and a water offloading pump to offload the water out of the water ballast compartment. The pair of offloading pumps includes a waster loading pump to load the water into the water ballast compartment and a liquid offloading pump to offload the liquid out of the liquid storage compartment.

In other embodiment, the liquid storage, loading and offloading system further comprises an equal mass flow rate displacement system to keep a constant operating weight such that the pair of loading pumps operate substantially at equal mass flow rate to displace the water with the liquid; and also such that the pair of offloading pumps operate substantially at equal mass flow rate to displace the liquid with the water.

In other embodiment, a liquid storage, loading and offloading system further comprises a fixing device to fix the artificial island on the seabed to form a fixed artificial island. The weight of the fixed artificial island at high water level is larger than the buoyancy of the artificial fixed island. While the liquid inside the artificial fixed island is drained, the weight of the artificial island is lighter than the buoyancy for removing and relocating.

In still other embodiments, a liquid storage, loading and offloading system further comprises a mooring positioning system to moor the artificial island on the seabed in a floating condition to form a floating artificial island. In still other embodiments, a liquid storage, loading and offloading system further comprises solid ballast adjacent to the artificial island to increase damping and to improve a hydrodynamic performance. The diameter of the solid ballast is equal to or larger than the diameter of the storage tank. In still other embodiments, the solid ballast is selected from the group consisting of a protruding skirt-shaped bottom solid ballast compartment, a protruding skirt-shaped lower solid ballast compartment, and a wheel-shaped solid ballast compartment.

BRIEF DESCRIPTION OF THE DRAWINGS

The drawings described herein are for illustrating purposes only of selected embodiments and not all possible implementation and are not intended to limit the scope of the present disclosure.

FIG. 3-1 is a sectional view of a multi-tank liquid storage with a cylinder tank-in-tank type of the storage cell.

FIG. 3-2 is a cross-sectional view of the vertical multi-tank liquid storage with the cylinder tank-in-tank type of the storage cell taken along line AA' in FIG. 3-1.

FIG. 4-1 is a sectional view of a vertical multi-tank liquid storage with multiple pedal-shaped tank-in-tank storage cells.

FIG. 4-2 is a cross-sectional view of the vertical multi-tank liquid storage with multiple pedal-shaped tank-in-tank storage cells taken along line AA' in FIG. 4-1.

FIG. 5-1 is a sectional view of a vertical multi-tank liquid storage with a master and secondary storage cell.

FIG. 5-2 is a cross-sectional view of the vertical multi-tank liquid storage with a master and secondary storage cell taken along line AA' in FIG. 5-1.

FIG. 7-1 is a sectional view of an A-type SPAR multi-layer multi-tank.

FIG. 7-2 is a cross-sectional view of the A-type SPAR multi-layer multi-tank taken along line AA' in FIG. 7-2.

FIG. 8-1 is a sectional view of a B-type SPAR type multi-layer multi-tank.

FIG. 8-2 is a cross-sectional view of the B-type SPAR multi-layer multi-tank taken along line AA' in FIG. 8-1.

FIG. 9-1 is a sectional view of an A-type vertical honeycomb multi-tank with multiple sets of rotational symmetric storage cells (rectangular).

FIG. 9-2 is a top view of the A-type vertical honeycomb multi-tank with multiple sets of rotational symmetric storage cells.

FIG. 10-1 is a sectional view of an A-type vertical honeycomb multi-tank with multiple sets of rotational symmetric storage cells (circle).

FIG. 10-2 is a cross-sectional view of the A-type vertical honeycomb multi-tank with multiple sets of rotational symmetric storage cells taken along line AA' in FIG. 10-1.

FIG. 11-1 is a sectional view of a vertical multi-tank liquid storage with a protruding skirt-shaped lower solid ballast compartment.

FIG. 11-2 is a cross sectional view of a vertical multi-tank liquid storage with a protruding skirt-shaped lower solid ballast compartment taken along line AA' in FIG. 11-1.

FIG. 12-1 is a top view of a wheel-shaped solid ballast compartment.

FIG. 12-2 is a cross sectional view of the wheel-shaped solid ballast compartment taken along line AA' in FIG. 12-1.

FIG. 13-1 is a horizontal multi-tank liquid storage with multiple bamboo poles storage cells.

FIG. 13-2 is a cross sectional view of the horizontal multi-tank liquid storage with multiple bamboo poles storage cells taken along line AA' in FIG. 13-1.

FIG. 14-1 is a sectional view of a multi-layer tower ladder multi-tank with multi sets of storage cells.

FIG. 14-2 a cross sectional view of the multi-layer tower ladder multi-tank with multi sets of storage cells taken along line AA' in FIG. 14-1

FIG. 15-1 a sectional view of a honeycomb multi-tank liquid storage in flat box-shaped.

FIG. 15-2 is a top and perspective view of the honeycomb multi-tank liquid storage in flat box-shaped.

FIG. 23-1 is a side view of a liquid storage, loading and offloading system with a bottom-supported and floating platform and single platform leg.

FIG. 23-2 is a cross sectional view of a bottom-supported and floating platform taken along line AA' in FIG. 23-1.

FIG. 25-1 a side view of a liquid storage, loading and offloading system with a bottom-supported and floating platform with A or B SPAR type multi-layer multi-tank.

FIG. 25-2 is a cross sectional view of a bottom-supported and floating platform taken along line AA' in FIG. 25-1.

FIG. 26-1 is a side view of a liquid storage, loading and offloading system with a bottom-supported and floating platform with C SPAR type multi-layer multi-tank.

FIG. 26-2 is a cross sectional view of a bottom-supported and floating platform taken along line AA' in FIG. 26-1.

FIG. 26-3 is a cross sectional view of a bottom-supported and floating platform taken along line BB' in FIG. 26-1.

FIG. 26-4 is a cross sectional view of a bottom-supported and floating platform taken along line CC' in FIG. 26-1.

DETAILED DESCRIPTION OF THE PREFERRED EMBODIMENT

The following description of the preferred embodiment is merely exemplary in nature and is no way intended to limit the invention, its application, or uses. Example embodiments will now be described more fully with reference to the accompanying drawings.

It is understood that the liquid storage, loading and offloading system can be used in any body of water. The term "liquid" comprises crude oil and other hydrocarbon liquids. In addition, the term "liquid" in this disclosure, with respect to liquid storage, does not refer to a physical state of a matter. Instead, the term "liquid" in this disclosure, with respect to liquid storage, refers to a target substance for storage that is different from the ambient water of the body of water within which the instant storage device is disposed. The term "water" comprises seawater and fresh water.

A Liquid Storage, Loading and Offloading System

Figure 1:
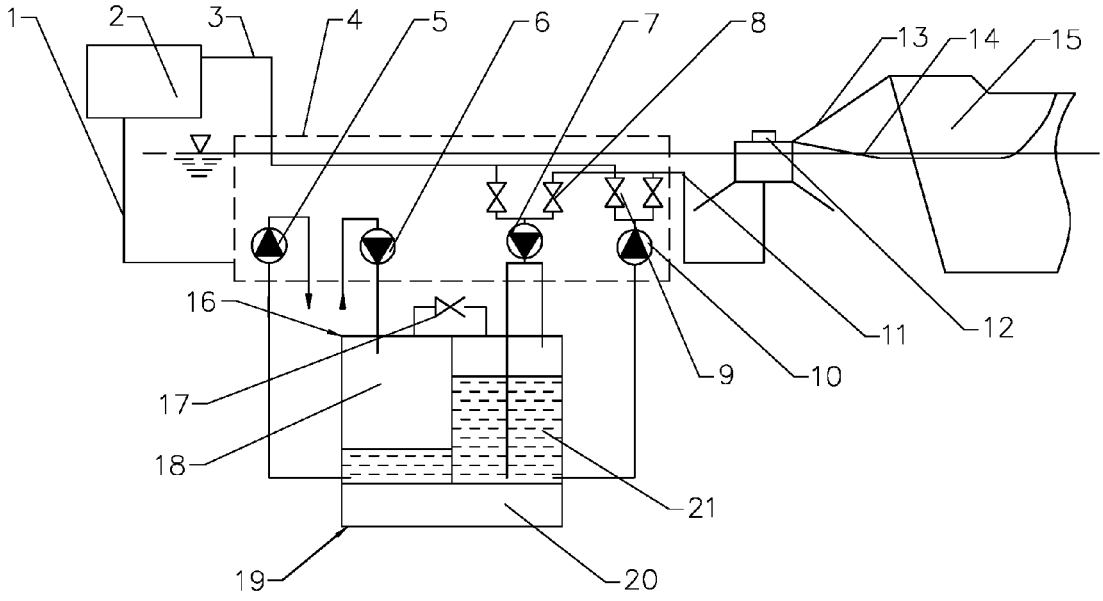
FIG. 1 is a liquid storage, loading and offloading system flow chart.

FIG. 1 illustrates a flow chart of a storage, loading and offloading system in accordance with an embodiment of the present invention. The loading and offloading system could include four main parts as follows.

1. A multi-tank liquid storage (hereinafter referred as multi-tank) 19. The multi-tank 19 includes one or more sets of storage cells 16. The storage cell 16 includes at least one seawater ballast compartment 18 and at least one liquid storage compartment 21. Inert gas is filled in the top of the seawater ballast compartment 18 and the liquid storage compartment 21, both of which are connected to each other through an automatic valve 17. The multi-tank 19 can optionally include one or more solid ballast compartment 20 under the storage cell 16. The solid ballast compartment can be replaced by ballast material, which is added directly to the bottom of the storage cell 16. In some embodiments, valve 17 does not operate automatically, but is user-selectively controlled.

2. A pump module 4. The pump module 4 includes at least one group of linkage pumps. Each group includes at least one pair of offloading pumps and one pair of loading pumps. The pair of offloading pumps includes seawater loading pump 6 and liquid offloading pump 10. The pair of loading pumps includes seawater offloading pump 5 and liquid loading pump 7. All pumps within the pump module 4 start, operate, and stop at equal mass flow rate. The liquid loading pump 7 can be applied with a pair of converting valves 8. Through the operation of converting valves 8, the liquid storage, loading and offloading system can receive liquid from onshore or offshore production facilities or from a shuttle tanker 15 by a single point mooring system (hereinafter referred as SPM) 12. The liquid offloading pump 10 can also be applied with a pair converting valves 9. Through the operation of converting valves 9, the liquid storage, loading and offloading system can offload liquid to the shuttle tanker 15 by SPM 12 or to onshore facilities by a subsea pipeline 3. The pump module 4 may include an assembly of corresponding pipelines, control valve, field instrument, control and implementation components which are not shown in the figure. If multiple storage cells are in operation, the corresponding pipelines may be required for linking them together.

3. A SPM 12 for a shuttle tanker 15, which can be connected with the SPM 12 by a mooring line 13 and a floating hose 14. The SPM 12 can be constructed and integrated with the multi-tank 19 by using SALM or similar SPM systems. The SPM 12 also can be constructed separately and installed above or near to the multi-tank by using any other forms of SPM systems compatible with the sea conditions, such as centenary anchor leg mooring (CALM) or submerged turret loading and mooring (STL) etc. For the sea area having good conditions, SPM can be replaced by a spread mooring system.

4. A working station 2. The working station is for providing electrical power and remote control. It can be built onshore or offshore.

The multi-tank 19, the pump module 4, the SPM 12, and the working station 2 can be connected with each other by a composite cable 1, a subsea pipeline 3, and a subsea flexible riser 11 to form a loading and offloading system with "equal mass flow rate displacement system for seawater ballast and stored liquid under an interconnected and airtight condition."

Equal Mass Flow Rate Displacement System for Seawater Ballast and Stored Liquid under A Closed Interconnected Condition.

With reference to FIG. 1, the equal mass flow rate displacement system (hereinafter referred as displacement system) preferably includes a multi-tank 19 and a pump module 4. A seawater ballast compartment 18 and a liquid storage compartment 21 are connected with each other by an automatic valve 17. During the operation of loading liquid and offloading seawater or the operation of offloading liquid and loading seawater, the automatic valve 17 opens automatically and the seawater ballast compartment 18 and the liquid storage compartment 21 become a closed interconnected system with pressurized inert gas. However, if any emergency happens, such as irregular pressure or accidents, the automatic valve 17 will close automatically. Then, two compartments become two independent systems. In some embodiments, the automatic valve 17 can be ignored by interconnecting the seawater ballast compartment 18 with the liquid storage compartment 21 directly. However, emergency situation can't be responded adequately without the automatic valve 17. Forming two independent systems is an important strategy to prevent pollution of liquid leakage.

The process of the displacement system is illustrated as follows. First, while either seawater or liquid is offloaded, the other one will be loaded at equal mass flow rate to maintain constant equal mass through the operation of the linkage pumps. Second, two steps of offloading stored liquid or seawater are as follows. The first step is to transport stored liquid or seawater from the bottom of the compartment to the inlet of the offloading pump by the pressure energy of inert gas. In one embodiment, at equilibrium, the inert gas is not pressurized. In another embodiment, an operator can selectively pressurize the inert gas so that no pumps are necessary to offload the liquid and/or the water. The second step is to offload stored liquid or seawater by the offloading pump. In one preferred embodiment, if the back-pressure of inert gas is large enough, the liquid and seawater offloading pump is not necessary. While offloading stored liquid or seawater, the volume of inert gas increases in this compartment. Therefore, to supply with inert gas to maintain constant pressure is required. Third, at the same time, while the other liquid is loaded in the compartment at equal mass flow rate, the inert gas in this compartment will be discharged to the other compartment, where stored liquid or seawater is offloaded. Therefore, the pressure energy of inert gas in the compartment, where stored liquid or seawater is offloaded, could be supplied. Then, the variation of pressure of inert gas can be controlled within a small range.

For example, in one embodiment, an operator initiates loading of seawater (the valve between the water compartment and the liquid compartment is open), and the pressure energy increases to force offloading of the liquid. A liquid offloading pump is then not necessary.

In yet another embodiment, the valve between the water compartment and the liquid compartment is open, the operator introduces more volume of the inert gas into at least one of the chambers to increase the pressure energy, thereby forcing offloading of the liquid. A liquid offloading pump is then not necessary.

In yet other embodiments, a combination of loading water and introducing more inert gas is used. In further embodiments, a combination of pressure energy and offloading pump is used to offload liquid/water.

If the specific gravities of seawater and stored liquid are different, "equal mass flow rate displacement" can't be equal to "equal volume flow rate displacement." Therefore, the pressure of inert gas in the top of seawater ballast compartment 18 and liquid storage compartment 21 changes with the variation of volume. Based on theoretical calculation, the relation between the change of the maximum pressure of inert gas Pmax and the minimum pressure of inert gas Pmin, the specific gravity of stored liquid $\gamma 1$, and the specific gravity of seawater ballast $\gamma w$ (set: $\gamma 1<\gamma w$) is as follows: $1>Pmin/Pmax>\gamma 1/\gamma w$. It means that when the specific gravity of the stored liquid is less than the specific gravity of seawater ballast, the ratio of the Pmax and Pmin is slightly larger than the ratio of the gravity of stored liquid and the gravity of seawater ballast.

Besides, to comply with the needs of heating stored liquid and thermal insulation, there are two outlets of liquid loading pump 7. One is located at the bottom of the liquid storage compartment 21. The heated storage liquid is transported directly to the bottom for meeting the normal loading condition. The other is located at the top of the liquid storage compartment 21. When stored liquid needs to be cycled for thermal insulation, close the bottom outlet, open the top outlet, and transport the heated stored liquid to the top. At the mean time, cold liquid is offloaded at equal mass flow rate through liquid offloading pump 10 for heating in outside heat exchangers (not shown in the FIG. 1).

In summary, the displacement system has the following utilization. First, the displacement system can receive and store liquid from an oil production facility offshore or onshore, such as oil, and then transport stored liquid to the shuttle tanker 15 by SPM 12; or receive and store liquid from the shuttle tanker 15 by SPM 12, such as oil, and then transport stored liquid to other location by the subsea pipeline 3 or another SPM 12. Some embodiment according to the present invention becomes an offshore liquid storage, loading, and offloading terminal and has the same function as onshore oil storage or oil terminal.

Three advantages of the process of the displacement system are as follows. First, no contact surface between stored liquid and seawater and no emission or supply of inert gas, which helps prevent pollution. Second, the pressure of inert gas is set by the hydrostatic pressure of water depth. After set up, the pressure difference between inside and outside of the seawater ballast 18 and liquid storage 21 is only related to the liquid heights inside two compartments, but not the outside water depth. The method result in small difference between inside and outside pressure, and therefore the stress of tank wall decreases. This advantage is more significant while applied in deeper sea. For example, for a 50 meters height storage cell (conservatively ignore the top inert gas and the height of bottom liquid residue), the pressure difference between inside and outside of the storage will be less than 50 meter water column static pressure, about 5 bar. Another example, supposing a storage cell of a multi-tank is at water depth of 1,000 m and the hydrostatic pressure outside the storage cell is about 100 bars and how to keep the pressure differences outside and inside the tank-unit as about 3 bars? We can install a safety valve at the top of the storage cell to set the relieving pressure as 3 bars, and set the final in-place inert gas pressure inside the storage cell as 103 bars which is pressurized from 3~103 bars step by step slowly with the water depths during lowering-down from water surface to the water depth of 1,000 m. During lifting-up gradually, the inert gas will be automatically relieved through the safety valve. Thus, we can keep the pressure difference about 3 bars during the two operations of lowing-down and lifting-up. Third, the ratio of volume of seawater ballast compartment 18 and the liquid storage compartment 21 is approximately 1:1. It seems a disadvantage that additional solid ballast is required to compensate the buoyancy caused by large empty volume in the compartments. However, if the self-weight of the multi-tank or its application is large enough to cause the negative buoyancy (operating weight minus buoyancy) become very small or zero, this disadvantage will become an advantage.

Multi-Tank Liquid Storage

With reference to FIGS. 2 to 15, multi-tank 19 can have varies designs, including a vertical type and a horizontal type. In some embodiments, the multi-tank has at least one of the following characteristics. In the preferred embodiment, all multi-tanks have all of the common characteristics as follows. First, the storage cell 16 within the multi-tank 19, including the seawater ballast compartment 18 and the liquid storage compartment 21, should be designed to be able to withstand internal and external pressure. The basic structure of multi-tank 19 is a spherical container, or a cylinder with an arch-shaped or a flat-shaped end seal plate, or any other structure, which is good for withholding pressure, such as a petal-shaped cylinder. Second, during the operation of the loading and offloading, the system preferably maintains the same operating weight. Also, for maintaining the center of gravity of a floating multi-tank along with Z axis, at which the center of buoyancy is located, the projected figure of the multi-tank on a horizontal sectional plane should be a rotational symmetric or central symmetric or up-down and left-right axis symmetric figure, and the center of projected figure should be overlapped by the projected center of gravity and center of buoyancy. In other words, symmetry of operating weight and the geometry symmetry of the multi-tank should be maintained during operation. Third, to prevent any damage from falling objects, the structure of multi-tank is enforced to avoid a crack by adding a double wall of the multi-tank or a protecting shield on the top of the multi-tank, etc. Besides, the "tank-in-tank" design, which will be illustrated as follow, also help to prevent pollution resulting from a crack of the multi-tank. Fourth, to make sure the stability of the multi-tank, its center of buoyancy is higher than its center of gravity.

1. Types of the Storage Cells for the Multi-Tank

The storage cell 16, which is within the multi-tank 19 and includes the seawater ballast compartment 18 and the liquid storage compartment 21, has two basic types: "tank-in-tank" and "not tank-in-tank" types.

(1) Tank-in-Tank Type

Figure 2:
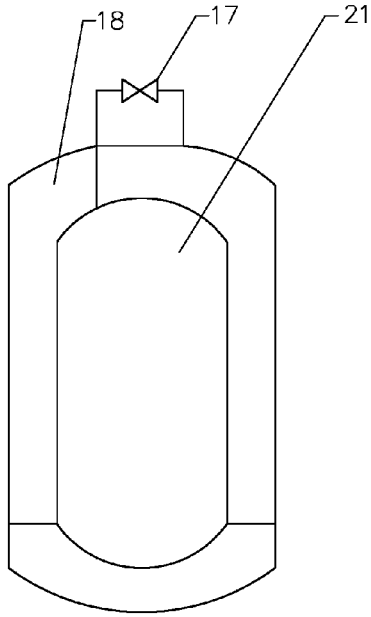
FIG. 2 is a perspective view of a vertical multi-tank liquid storage with a tank-in-tank storage cell.
Figures 1, 3:
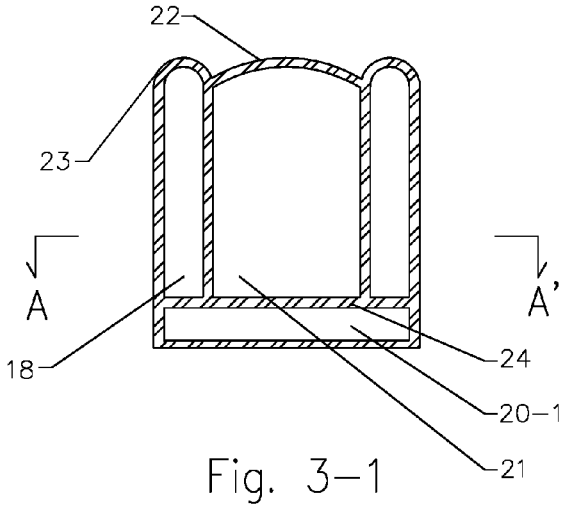
Figures 2, 3:
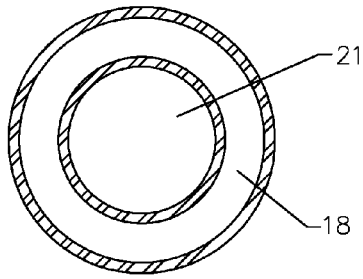

The storage cell in tank-in-tank type has the liquid storage compartment 21 surrounded by the seawater ballast compartment 18. There are three main designs of the tank-in-tank storage cell. The first type is called a cylinder tank-in-tank storage cell. With reference to FIGS. 2 and 3, both compartments are generally cylinder containers. The central axis of both compartments overlapped. FIG. 3-2, which is a cross sectional view of a multi-tank taken along A-A' in the FIG. 3-1, illustrates that cross sectional view of a vertical multi-tank and the vertical sectional view of a horizontal multi-tank are two concentric circles. Further, there are three types of end seal plates used in the storage cell: a flat-shaped end seal plate 24, a liquid storage compartment arch-shaped end seal plate 22, and a seawater ballast arch-shaped end seal plate 23.

Figures 1, 4:
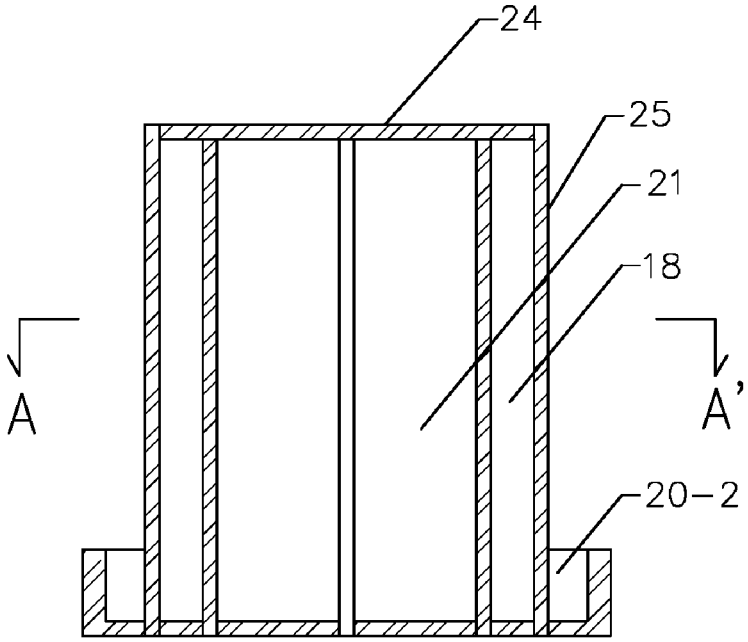
Figures 2, 4:
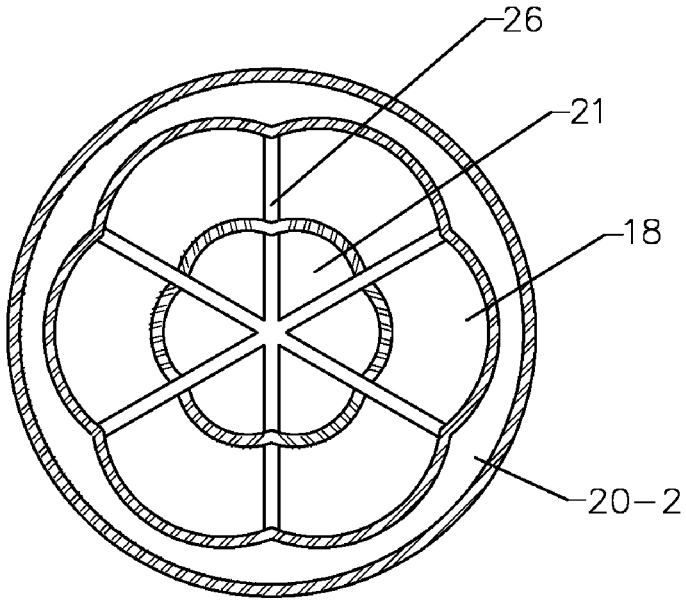

With reference to FIGS. 4-1 and 4-2, the second type is called a petal-shaped tank-in-tank storage cell. The basic structure of a petal-shaped tank-in-tank storage cell is similar to the cylinder tank-in-tank storage cell. Both seawater ballast compartment 18 and liquid storage compartment 21 are cylinder containers and rotational symmetric to the same central axis. The FIG. 4-2, a cross sectional view taken along AA' in FIG. 4-1, illustrates that each petal has the same radian and can be separated by a frame 26. The total number of the petal prefers an even number. Besides, the frame 26 can also be a watertight wall to form several independent storage cells.

Figures 1, 5:
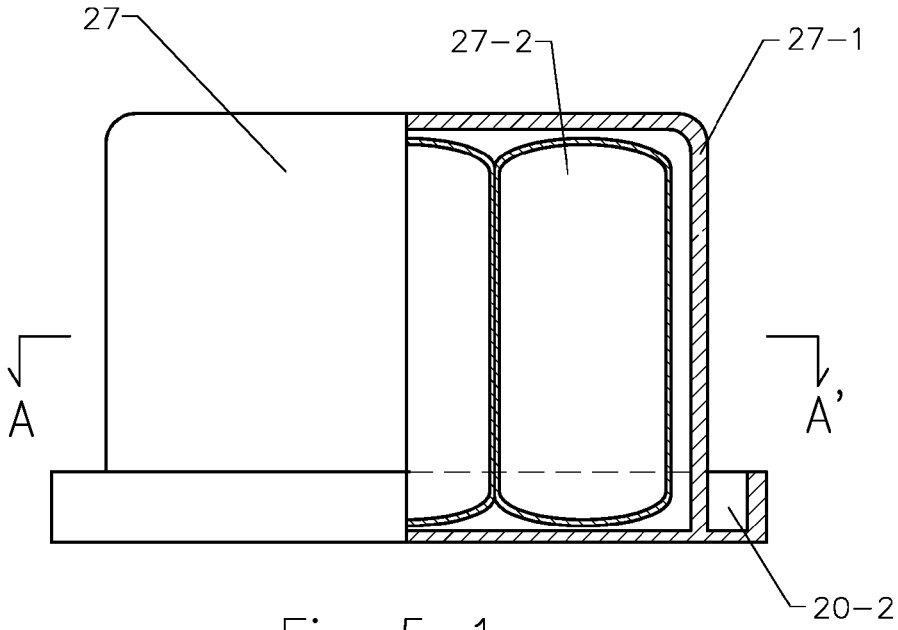
Figures 2, 5:
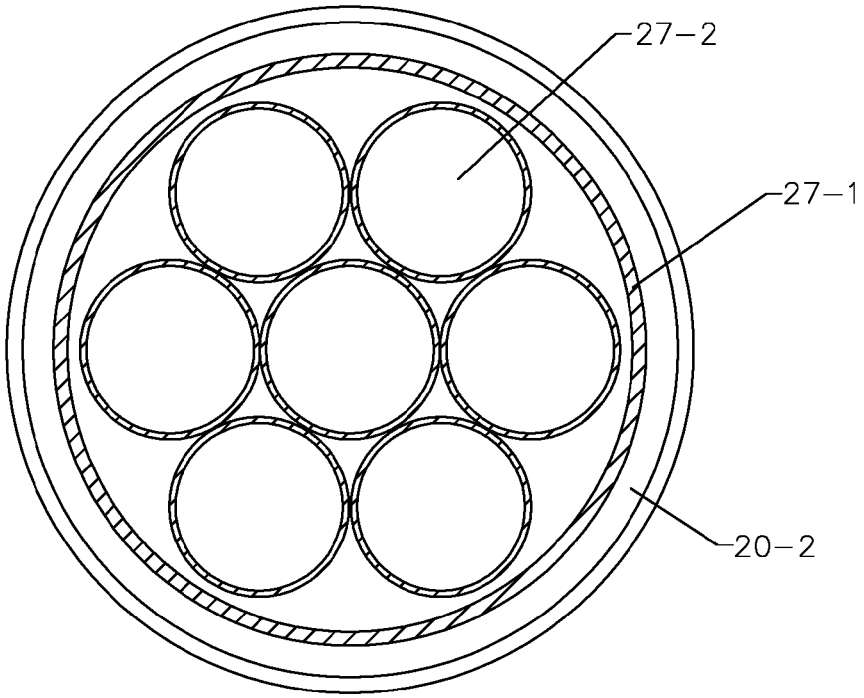

With reference to FIGS. 5-1 and 5-2, the third type is called a master and secondary storage cell. The master and secondary storage cell 27 has a master compartment 27-1 and a secondary compartment 27-2. The master compartment 27-1 is a big vertical cylinder for storing seawater ballast. Inside the master compartment 27-1, at least one group of the secondary compartment 27-2 is arranged in central symmetric pattern for storing the same liquid.

The tank-in-tank storage cell also has other kinds of designs, such as a spherical tank-in-tank storage cell.

(2) Not Tank-in-Tank

The storage cell not in tank-in-tank type means that the seawater ballast compartment and the liquid storage compartment are not surrounded with each other, but only adjacent to each other in symmetry. The non tank-in-tank storage cell has two main types as follows.

The first type is a single or multi-set of storage cells in the form of a single horizontal bamboo pole with multi-section (hereinafter referred as single bamboo pole storage cell). It looks like a bamboo pole, positioned horizontally and sealed in both ends in arch shape or flat shape. Each section in the storage cell is separated by a seal plate, like a bamboo pole with multi-section. Each seawater ballast compartment and the liquid storage compartment are like each of the section. The single bamboo pole storage cell can have 3 sections. The central section is the 100% full liquid storage compartment. The other two sections are the 50% full seawater ballast compartment at both ends and connected with each other by a pipe at the top and bottom respectively (passing the liquid storage compartment or being buried in the concrete wall) to form one seawater ballast compartment in substance. The single bamboo pole storage cell is in bilateral symmetry. More than one single bamboo pole storage cell can be connected head to tail horizontally to form a multi-set single bamboo pole storage cells. Also, multiple single or multi-set of storage cells in form of a single horizontal bamboo pole can be put together in parallel to form a single or multi-set of storage cells in form of multiple horizontal bamboo poles. The simple bamboo pole storage cell is preferably not used in a floating condition.

Figure 6:
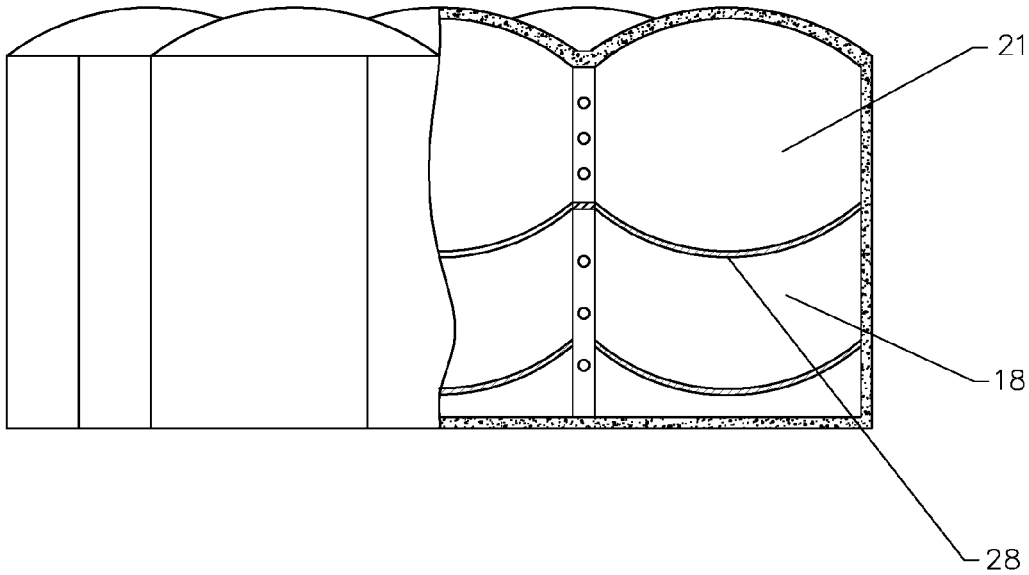
FIG. 6 is a sectional view of a vertical multi-tank liquid storage with a not tank-in-tank type storage cell.
Figures 1, 7:
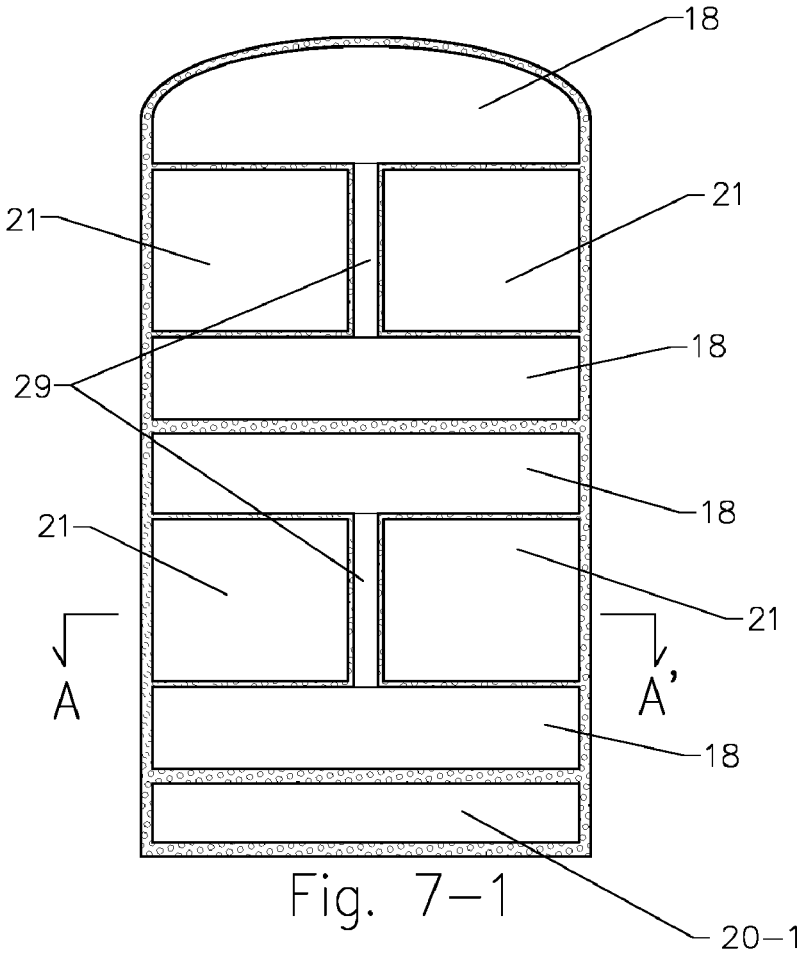
Figures 2, 7:
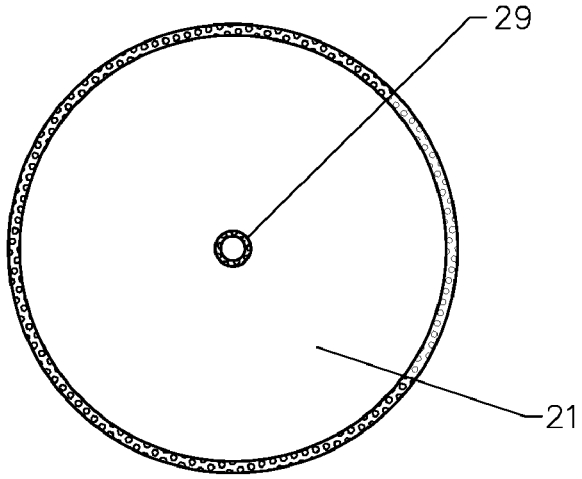

The second type is a storage cell having a seawater ballast compartment vertically adjacent to a liquid storage compartment. With reference to FIG. 6, the seawater ballast compartment 18 and the liquid storage compartment 21 are positioned vertically adjacent to each other and separated by a partition plate 28. However, this structure will cause large variation of the center of gravity, and therefore is not suitable to be used in a floating condition.

With reference to FIGS. 7-1, 7-2, 8-1 and 8-2, to avoid the disadvantage of the structure in FIG. 6, the improved structure has two seawater ballast compartments 18 at the top and bottom of the liquid storage compartment 21. Both seawater ballast compartments 18 are connected with each other by a pipe 29 to form one seawater ballast compartment 18 in substance. Multiple single set of the storage cell with this improved structure can be connected head to tail vertically to form a multi-set storage cells. In one embodiment, the lower storage cell has higher pressure of inert gas.

2. Types of Solid Ballast Compartments for the Multi-Tank

The function of a solid ballast compartment for a multi-tank is to balance extra buoyancy by adding ballast materials, such as iron or seawater, to lower the center of gravity of the multi-tank. There are 5 types of the solid ballast compartment as follows. The third, fourth, and fifth types are preferably used in floating condition.

With reference to FIGS. 3-1, 7-1, 8-1, 9-1, an implicit bottom solid ballast compartment 20-1 is the extension from the upper storage cell. The areas of the horizontal sectional planes of the solid ballast compartment 20-1 and the storage cell are exactly the same.

With reference to FIGS. 4-1, 4-2, 5-1, 5-2, 10-1, and 10-2, a protruding skirt-shaped bottom solid ballast compartment 20-2 surrounds the base of the upper storage cell and has a U-shaped vertical sectional plane, because its top is open. The purpose of an open top is for adding ballast easily. The protruding skirt-shaped bottom solid ballast compartment 20-2 also can be closed with a rectangle or O-shaped vertical sectional plane. Compared to the implicit bottom solid ballast compartment, the protruding shirt-shaped bottom solid ballast compartment benefits a fixed system because it decreases the scour at the bottom and is also good for a floating system because it can increase additional mass, radius of gyration, damping, and damping moment of the floater in 6 degrees of freedom to improve the motion response and hydrodynamic performance.

Figures 1, 11:
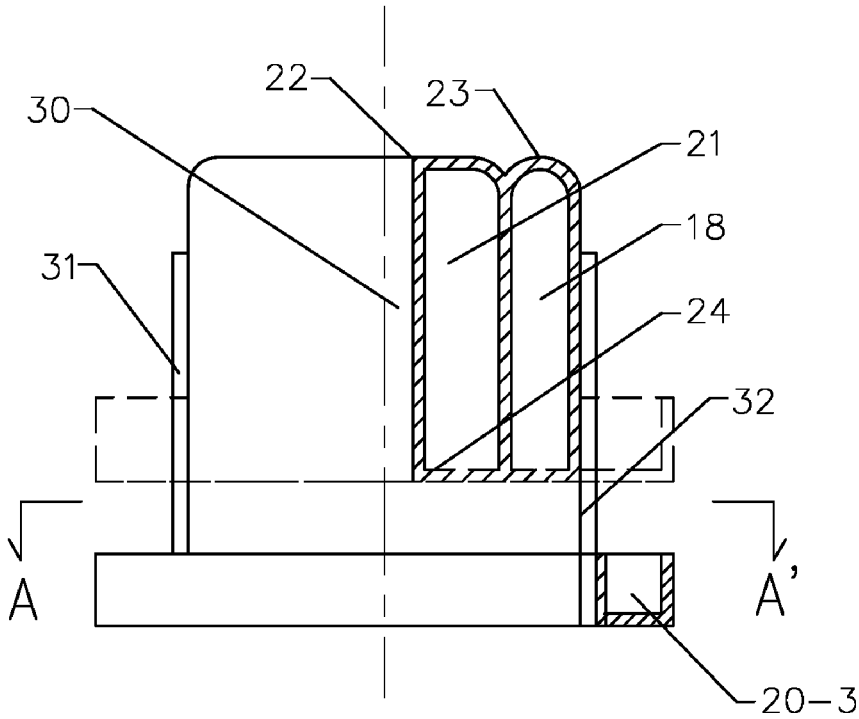
Figures 2, 11:
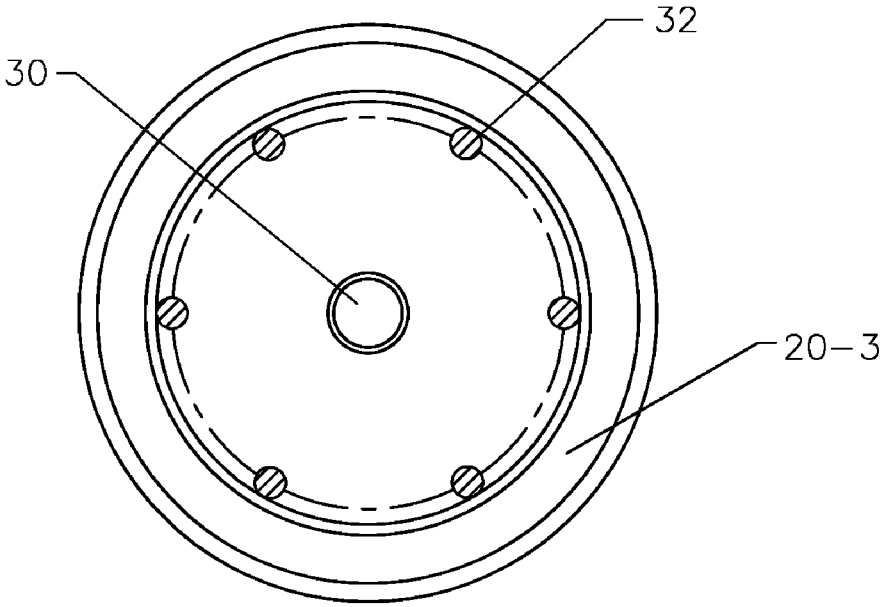

With reference to FIGS. 11-1 and 11-2, a protruding skirt-shaped lower solid ballast compartment 20-3 is similar to the protruding skirt-shaped bottom solid ballast compartment 20-2. However, the lower solid ballast compartment 20-3 can be applied with a locking device 31 and the steel leg 32 to move the along vertical direction.

Figures 1, 25:
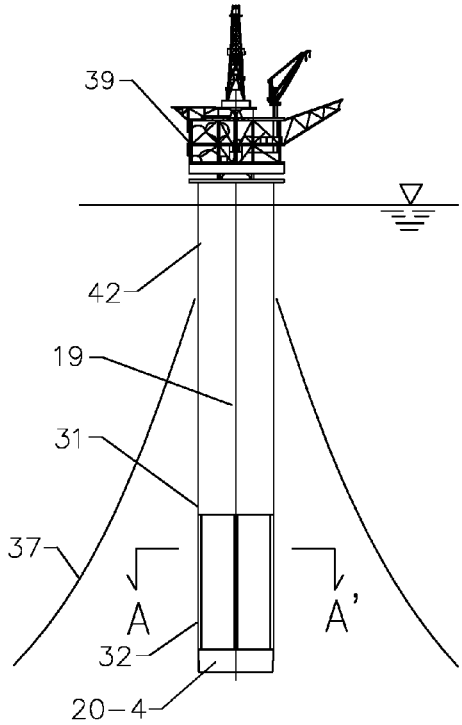
Figures 2, 25:
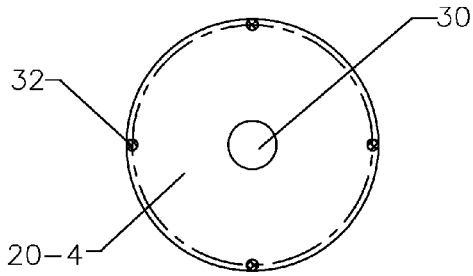

With reference to FIGS. 25-1 and 25-2, an implicit lower solid ballast compartment 20-4 is the combination of implicit bottom solid ballast compartment and the protruding skirt-shaped lower solid ballast compartment.

Figures 1, 12:
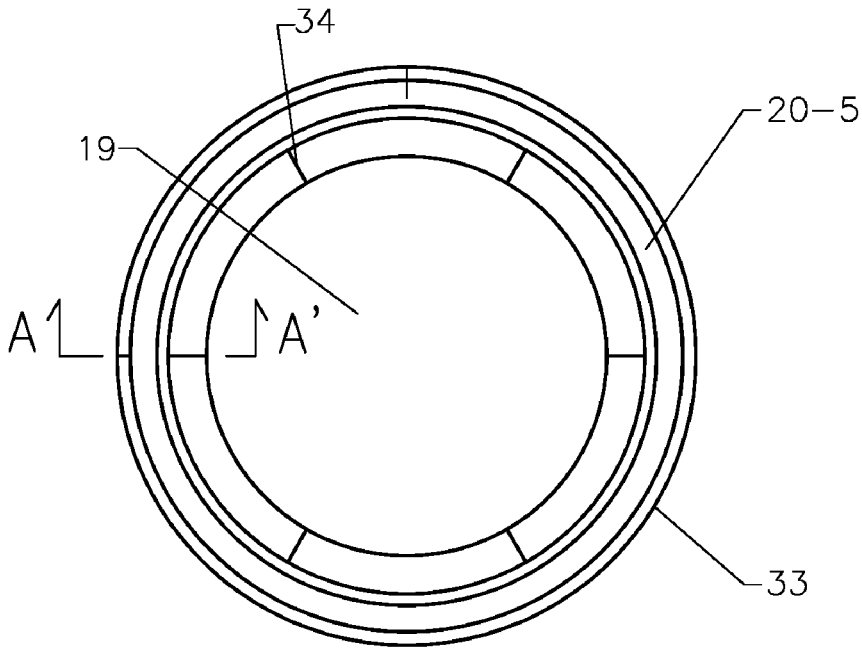
Figures 2, 12:
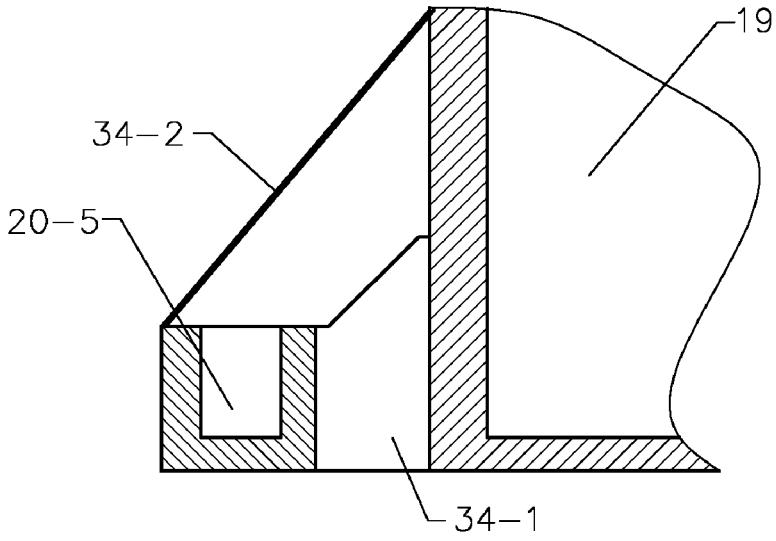

With reference to FIGS. 12-1 and 12-2, a wheel-shaped solid ballast compartment 20-5 includes: 1. a wheel compartment 33, which is a ring container with an open top or a closed top. The inner diameter of the wheel compartment is larger than that of the multi-tank 19, but has the same central axis. 2. Connecting device 34, which is for fixing the wheel compartment 33 in the bottom of the multi-tank 19, includes a connecting radial plate 34-1 and inclined tie bar 34-2, if necessary. The wheel-shaped solid ballast compartment has better hydrodynamic performance than the protruding skirt-shaped bottom solid ballast compartment because of better permeability.

Figures 1, 13:
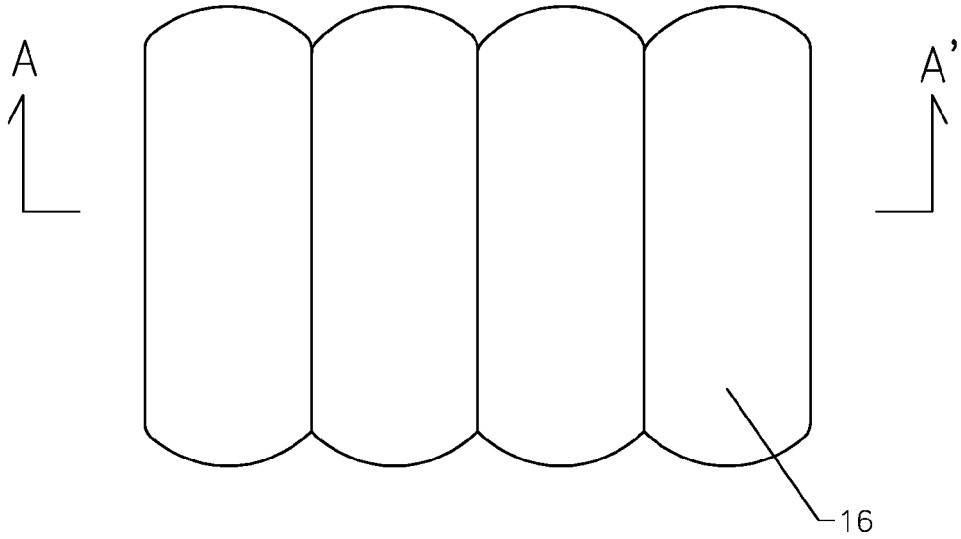
Figures 2, 13:
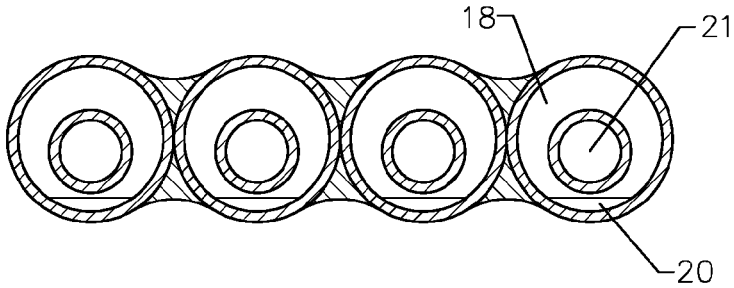

With reference to FIG. 13-2, which is a cross sectional view of taken along AA' in FIG. 13-1, the solid ballast compartment 20 can be replaced by adding ballast material at the bottom of seawater ballast compartment.

3. Symmetry of Multi-Tank: Vertical Rotational Symmetric Multi-Tank and Horizontal Multi-Tank The characteristic of a vertical rotational symmetric multi-tank is to have a central axis. The rotation of the structure is symmetric to the central axis. Its centers of gravity and buoyancy are moving along with this central axis. The vertical rotational symmetric multi-tank can also include a solid ballast compartment and are suitable for both floating and fixed system. Exemplary types of the vertical rotational symmetric multi-tanks are listed as follows.

1. Vertical multi-tank with a single set of a cylinder storage cell. The storage cell could be a tank-in-tank type or not tank-in-tank type. 2. Vertical multi-tank with a singe or multi sets of a petal-shaped storage cell. 3. A-type vertical honeycomb multi-tank with multiple sets of rotational symmetric storage cells. The storage cell is in tank-in-tank type (see FIGS. 9.10). 4. Vertical multi-tank with multiple sets of master and secondary storage cells (see FIG. 5). 5. B-type vertical honeycomb multi-tank with multiple sets of rotational symmetric storage cells. The compartments in the storage cell are arranged vertically adjacent to each other (see FIG. 6). 6. C-type vertical honeycomb multi-tank with multiple sets of rotational symmetric storage cells. Four storage cells form a set in honeycomb-shaped. 7. Multi-layer tower ladder multi-tank with multi sets of storage cells (please refer to FIG. 14-1). 8. A-type SPAR multi-layer multi-tank. The storage cell is in cylinder tank-in-tank type or not tank-in-tank type (see FIG. 7). 9. B-type SPAR multi-layer multi-tank. The multiple cylinders can be arranged closely together or directly touch an adjacent cylinder (see FIG. 8). 10. C-type SPAR multi-layer multi-tank. It appears that 3 or 4 vertical pipes arranged closely to form a pipe bundle. Type 1-7 are called pedestal type multi-tank.

Figures 1, 14:
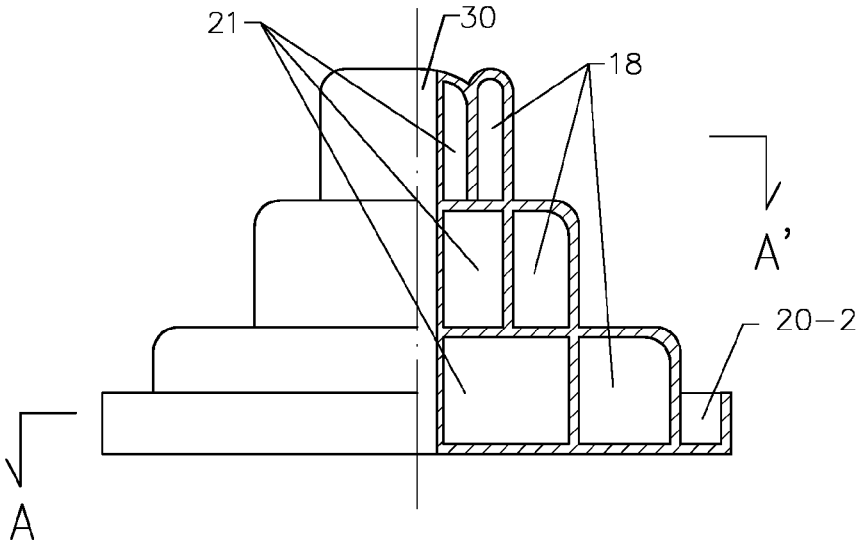
Figures 2, 14:
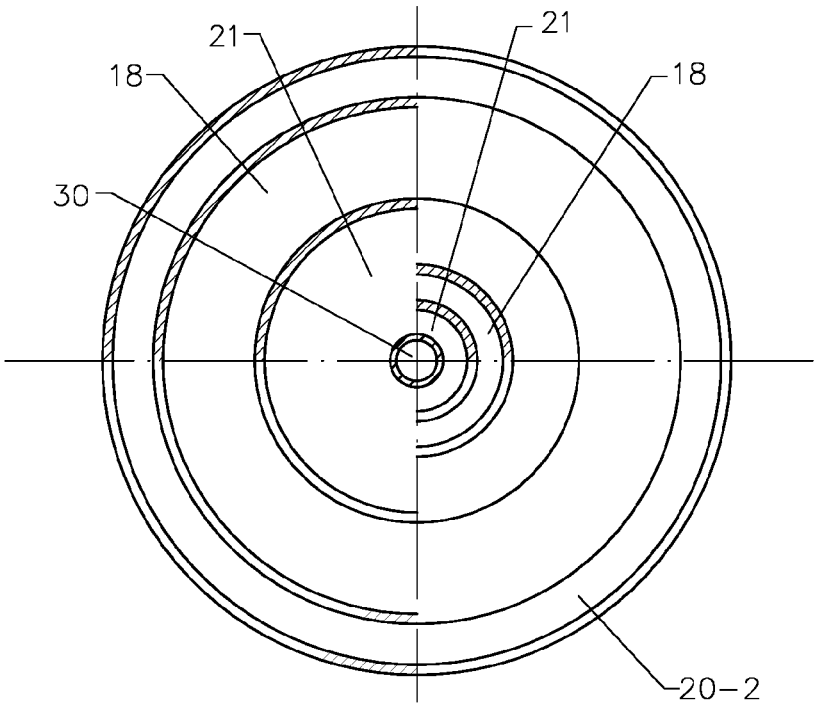
Figures 1, 15:
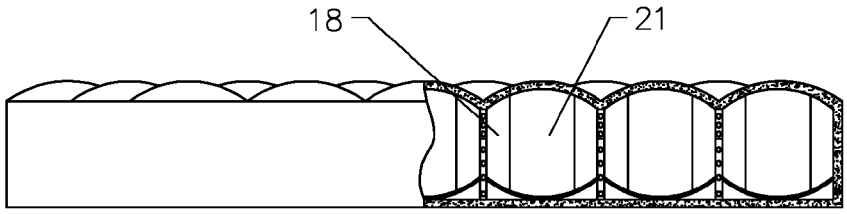
Figures 2, 15:
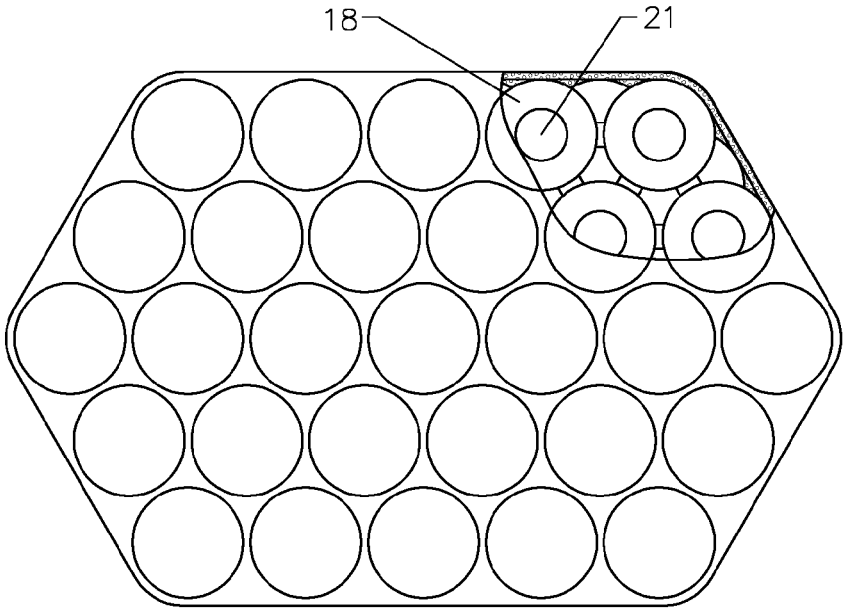

With reference to FIG. 14-1, the multi-layer tower ladder multi-tank with multiple sets of storage cells has at least two layers. The diameter of the bottom layer of the storage cell is larger than it of the upper layer of the storage cell. The single or multi sets of storage cells constitute tower ladder structure.

Figure 19:
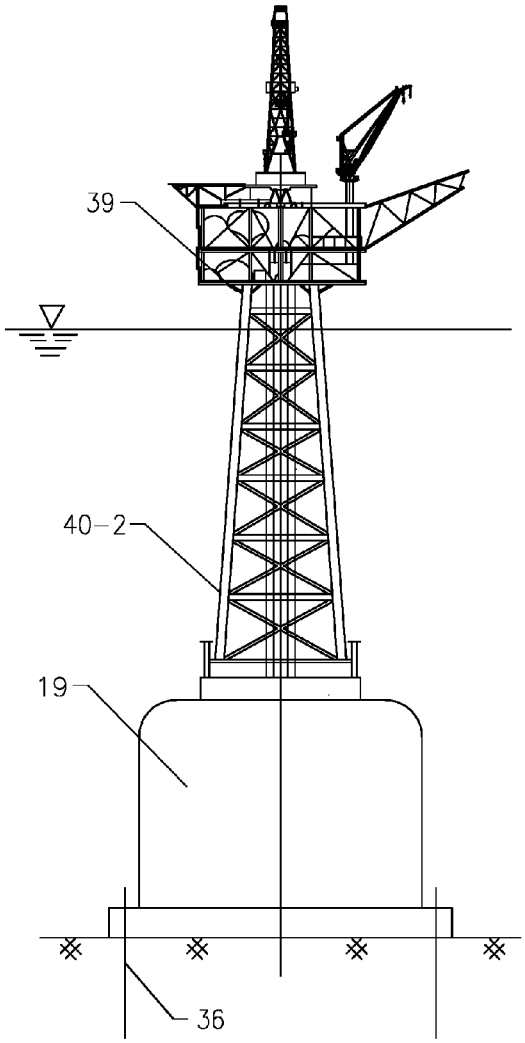
FIG. 19 is a side view of a liquid storage, loading and offloading system with a bottom-supported and fixed platform and a conventional jacket leg.
Figure 20:
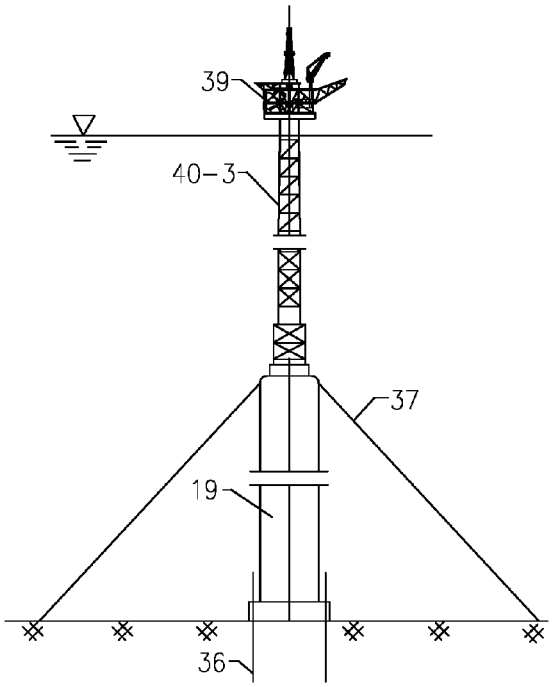
FIG. 20 is a side view of a liquid storage, loading and offloading system with a bottom-supported and fixed platform and a compliant tower leg.
Figure 21:
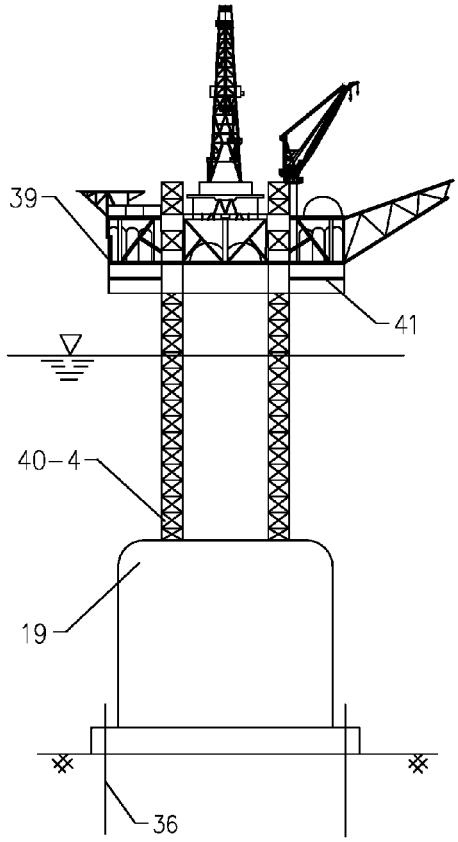
FIG. 21 is a side view of a liquid storage, loading and offloading system with a bottom-supported and fixed platform and a jack-up platform leg.
Figure 22:
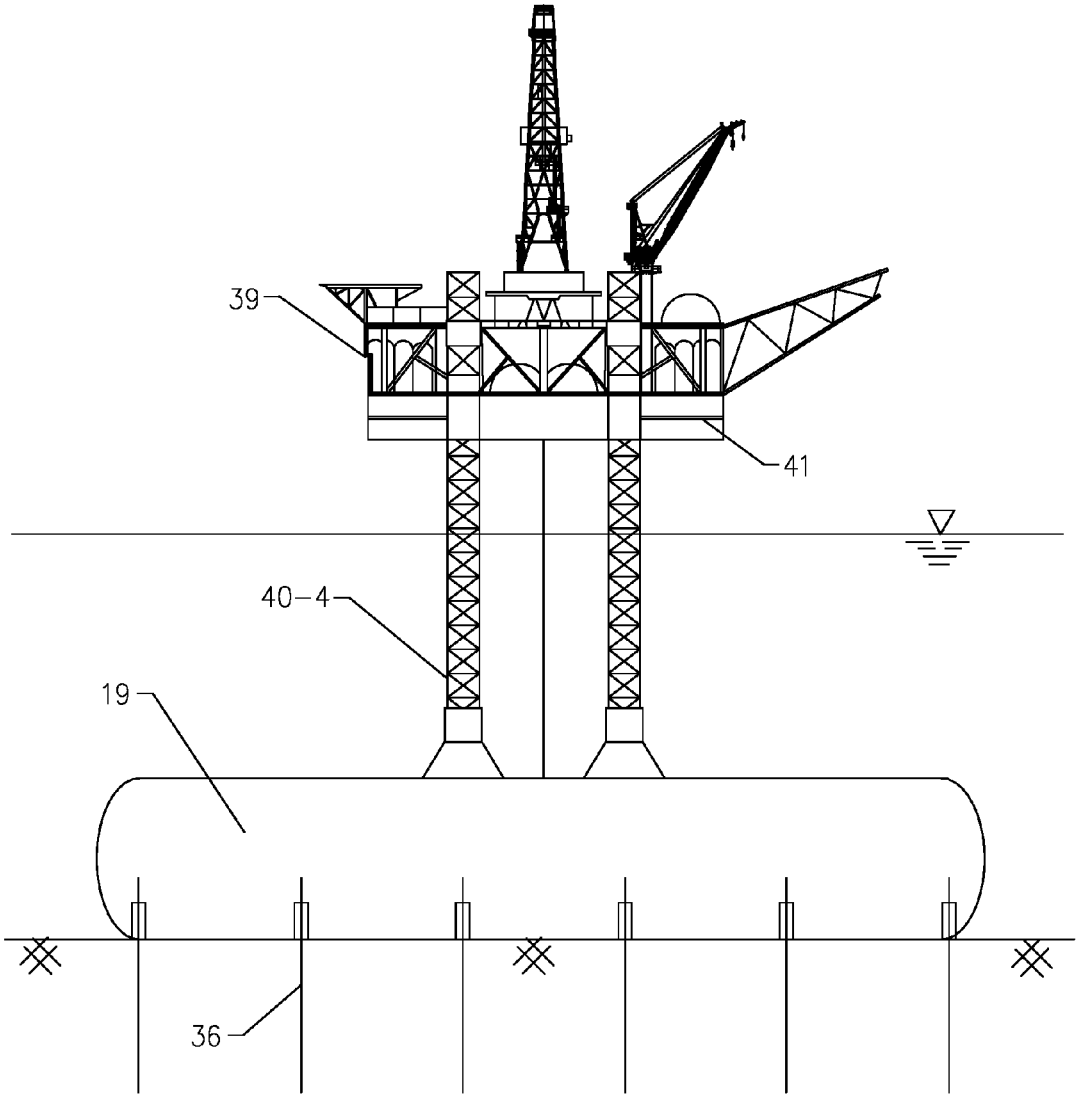
FIG. 22 is a side view of a liquid storage, loading and offloading system with a bottom-supported and fixed platform and a jack-up platform leg.
Figures 1, 23:
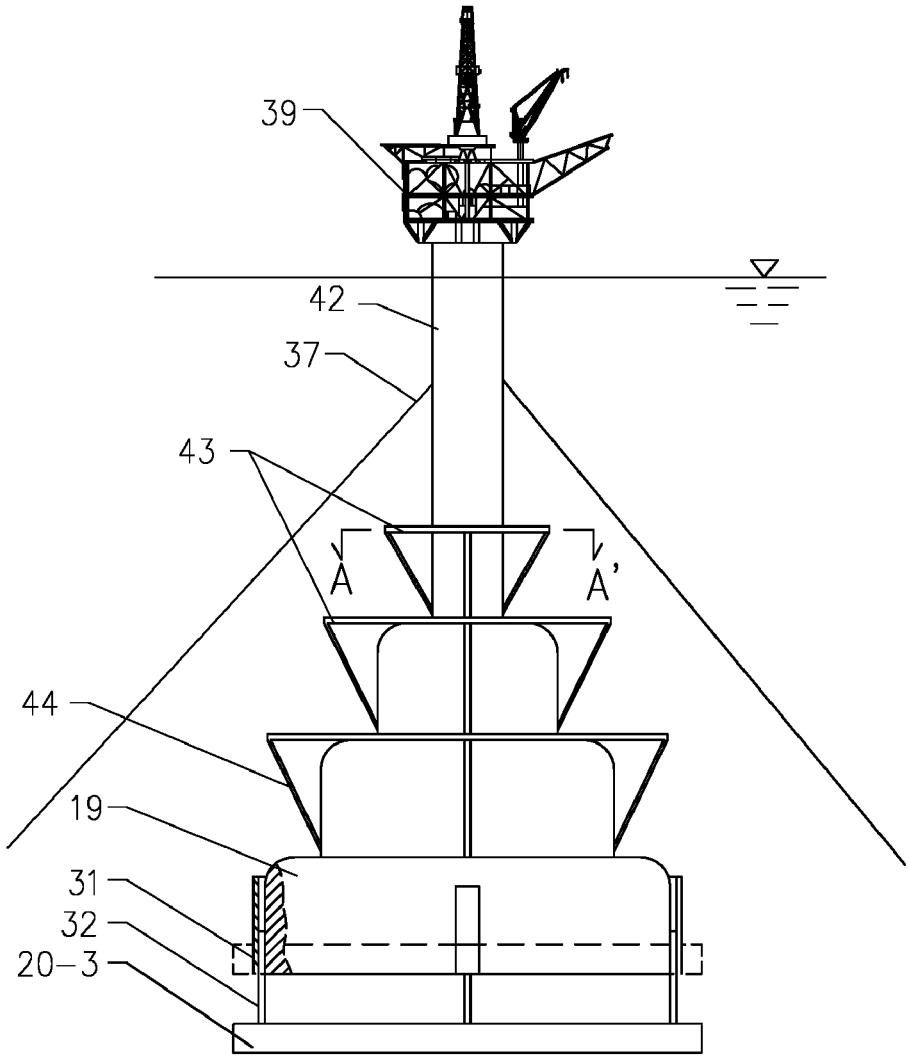
Figures 2, 23:
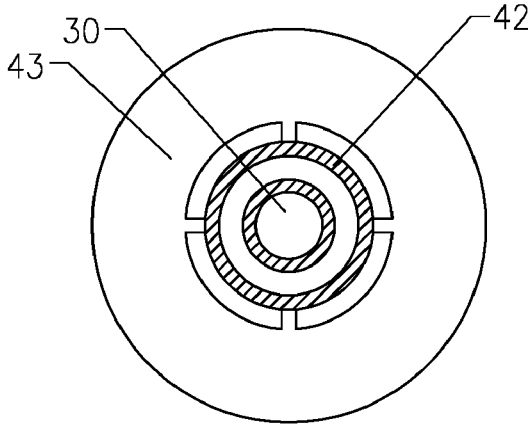

The SPAR type multi-tank is preferably applied with the SPAR type floating platform, and optionally also used with a special facility (please refer to FIG. 19, which will be illustrated later). With reference to FIG. 25-1, A-type SPAR multi-layer multi-tank (hereinafter referred as A SPAR) looks like a long vertical cylinder, which is constituted by multiple storage cells in cylinder tank-in-tank type connecting head to tail or by the storage cell having a seawater ballast compartment vertically adjacent to a liquid storage compartment (please refer to FIG. 7-1).

Figures 1, 8:
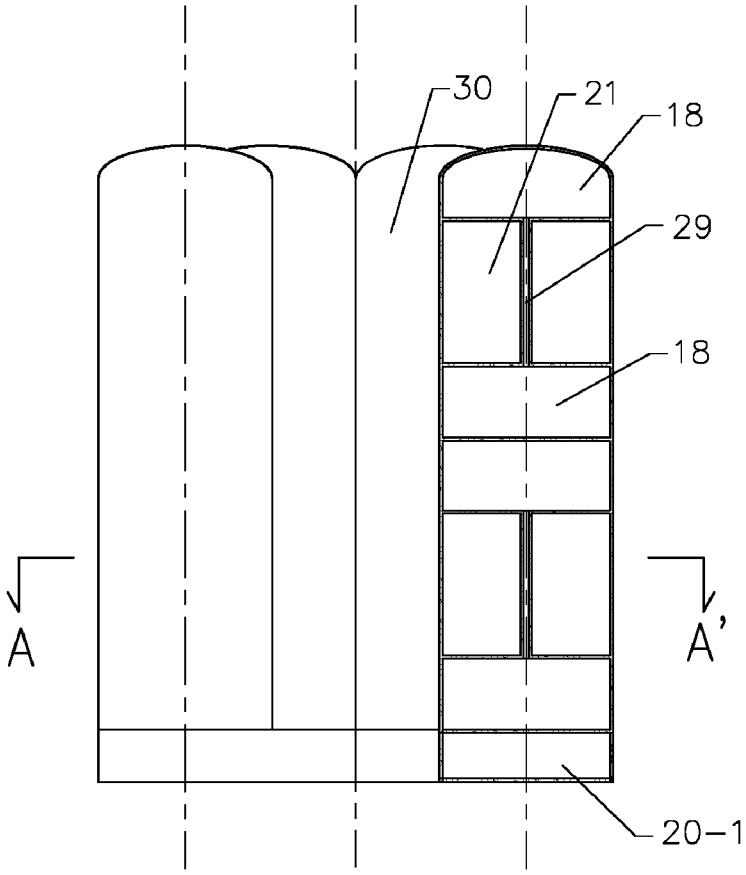
Figures 2, 8:
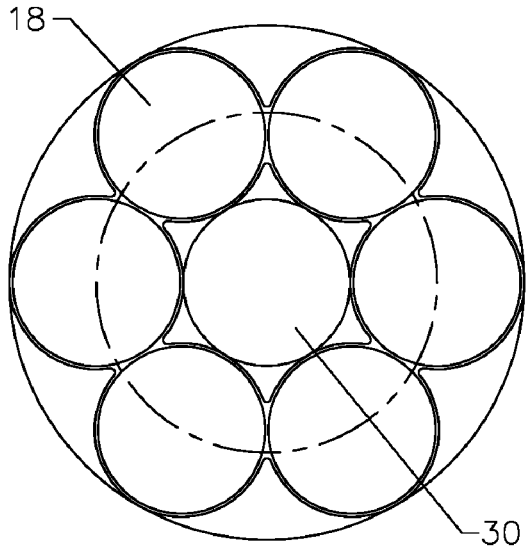
Figures 1, 9:
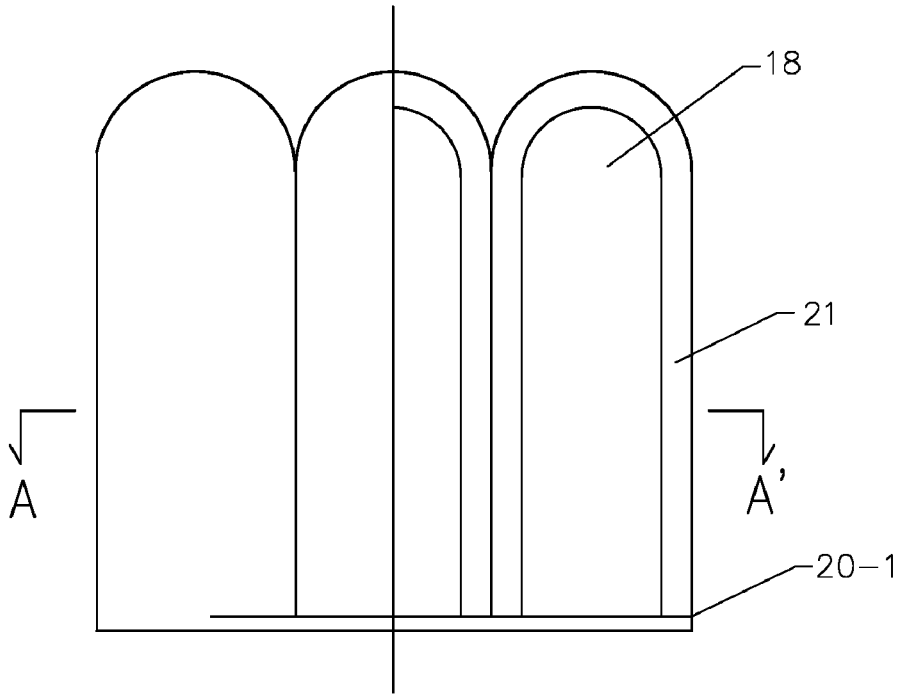
Figures 2, 9:
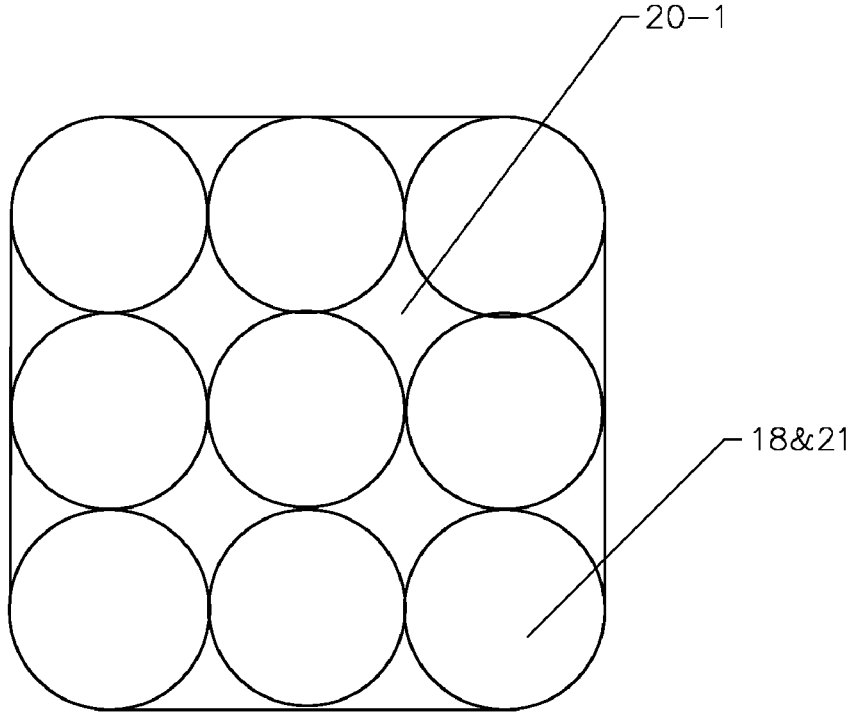
Figures 1, 10:
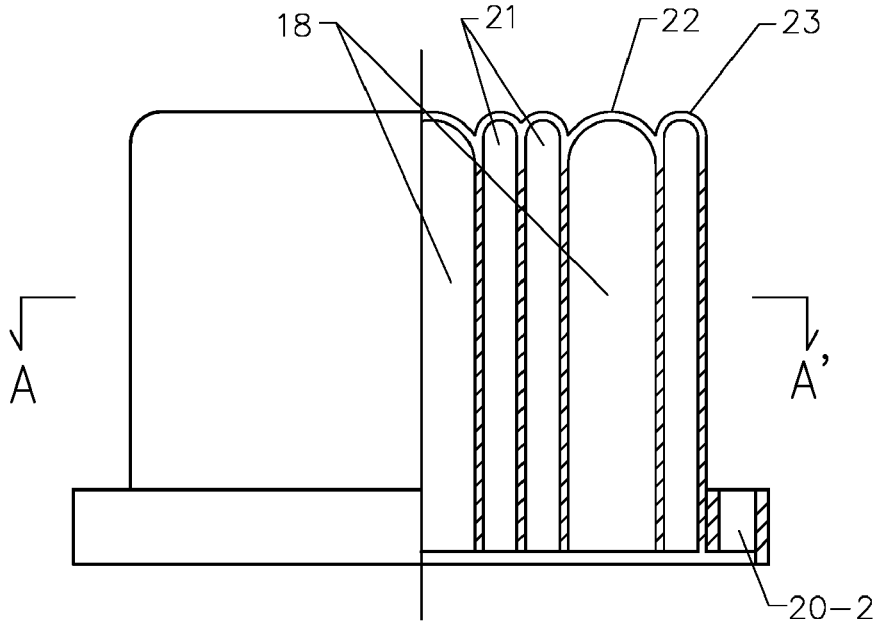
Figures 2, 10:
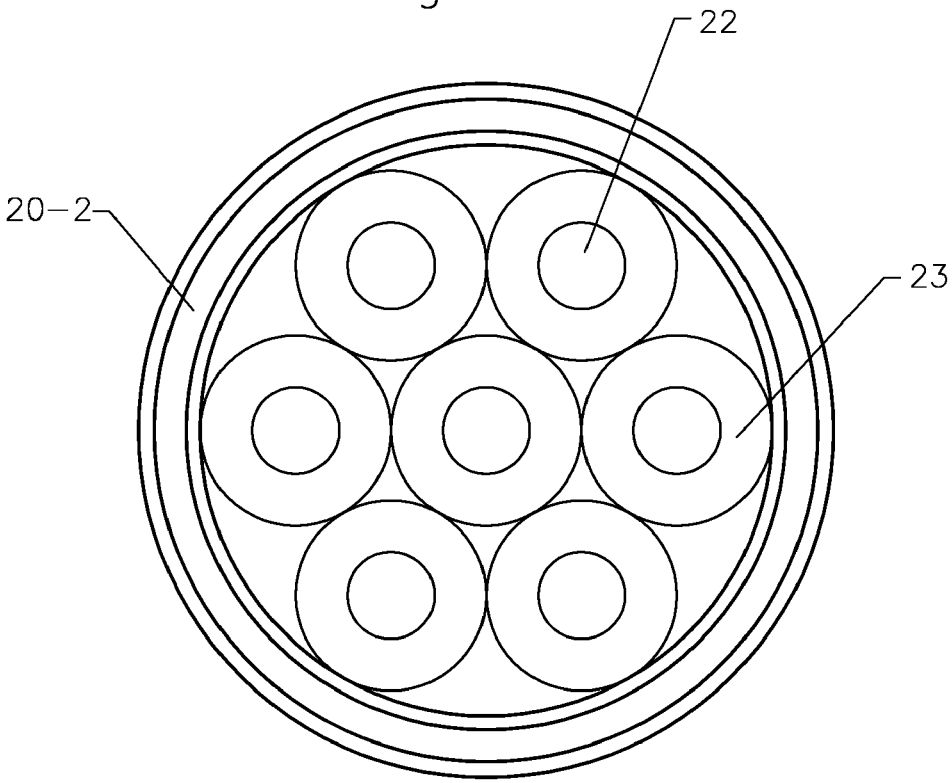

With reference to FIG. 8-1, B-type SPAR multi-layer multi-tank (hereinafter referred as B SPAR) looks like a pipe bundle. The pipe is preferably constituted by the storage cell having a seawater ballast compartment vertically adjacent to a liquid storage compartment. In FIG. 8-1, six pipes are arranged together with each other closely.

Figures 1, 26:
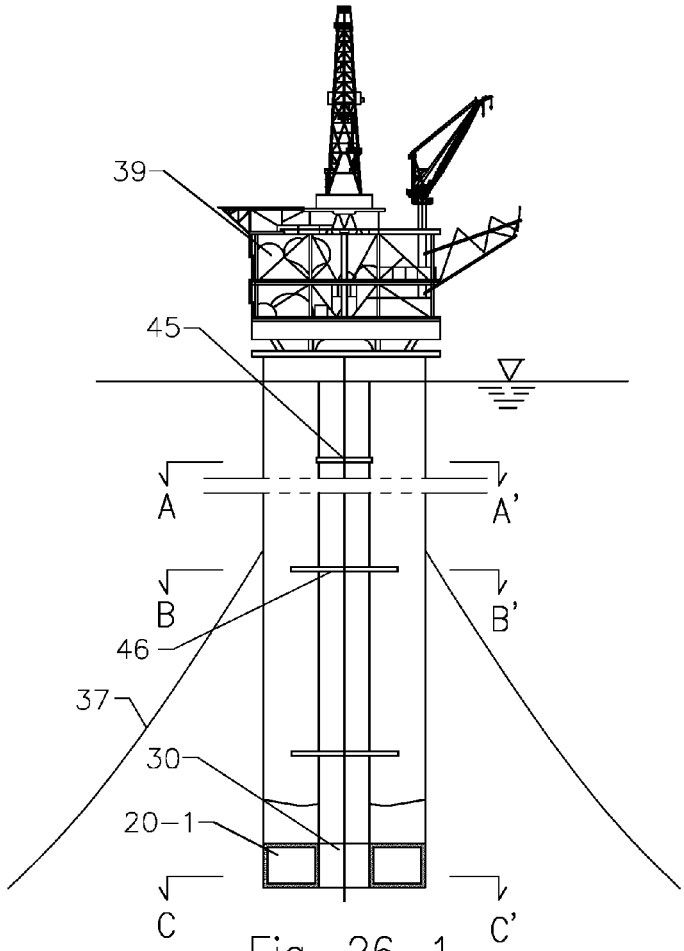
Figures 2, 26:
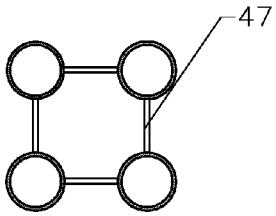
Figures 3, 26:
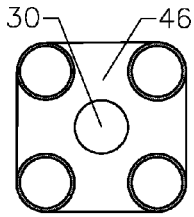
Figures 4, 26:
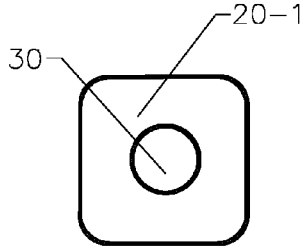

With reference to FIG. 26-1, C-type SPAR multi-layer multi-tank (hereinafter referred as C SPAR) looks like a pipe bundle in space. It may use 3 pipes, or 4 pipes (as illustrated in FIG. 26-1~26-4), or more. The pipe is preferably constituted by the storage cell having a seawater ballast compartment vertically adjacent to a liquid storage compartment. The FIG. 26-2, 26-3, 26-4 are the horizontal sectional views taken along A-A', B-B', and C-C' in FIG. 26-1 and illustrate that the horizontal frame 45, including 3 or 4 horizontal bar 47 to form a regular triangle or regular rectangle is connected with a damping plate 46 to form 3 or 4 pipes into a whole structure.

A SPAR and B SPAR can be formed in a single leg SPAR platform. C SPAR can be formed in a 3 or 4 legs SPAR platform. Preferably, the implicit solid ballast compartment can be applied with SPAR type multi-tank.

The honeycomb multi-tank is formed by gathering multiple storage cells tightly or with distance between them to become a honeycomb body. It can be rotated in rotational symmetry (please refer to FIGS. 8-2, 9-2, 10-2, 26-2, 26-3, and 26-4), and or formed in flat box-shaped (please refer to FIG. 15-1). Forming multi-tank in flat box-shaped means that the arrangement of the storage cells is in central symmetry or up-down and left-right symmetry. The horizontal multi-tank in flat box-shaped is preferably not used within a floating condition.

Another horizontal multi-tank is in shape of a bamboo raft and connected tightly by several horizontal tank-in-tank storage cells (see FIGS. 13-1, 13-2) or several multi-set single bamboo pole storage cells in a horizontal plane.

4. Materials Selection and Construction for Multi-Tank

The multi-tank can be made of concrete, steel, ferroconcrete, fiber-reinforced concrete, or other materials which can withstand pressure.

Concrete is a priority due to its distinctive advantages of anti-corrosion, thermal insulation, anti fatigue, lower maintenance cost, longer life, easy construction, lower required skills, shorter construction time, etc. Usually, the lower portion of the multi-tank is made of heavy concrete and the upper portion is made of light concrete for shifting the center of gravity of the multi-tank vertically downward.

The construction methods for the multi-tank and its attached facilities are the same as the methods for the existing offshore concrete gravity structures, including (onshore) dry one-step construction and dry & wet two-step construction. One-step method means that the multi-tank or whole loading and offloading system are all constructed onshore and then drag to offshore oilfield to install. Two-step method means that part of construction is done onshore and the other part of construction is done offshore. Dry dock or gravel dry dock is needed for both construction ways. For construction of the structure with small size and light weight, the dry dock can be replaced by the launching ways plus with semi-submersible barge or constructing it on semi-submersible barge directly.

Applications of the Loading and Offloading System with the Liquid Storage Apparatus A loading and offloading system with a liquid storage apparatus can include a multi-tank liquid storage, a pump module, a SPM or equivalent and a working station. Besides, the loading and offloading system can be applied with hydrocarbon production facilities for drilling or producing hydrocarbon. Exemplary applications and configuration are as follows.

1. Loading and Offloading System with Fixed Liquid Storage

Figure 16:
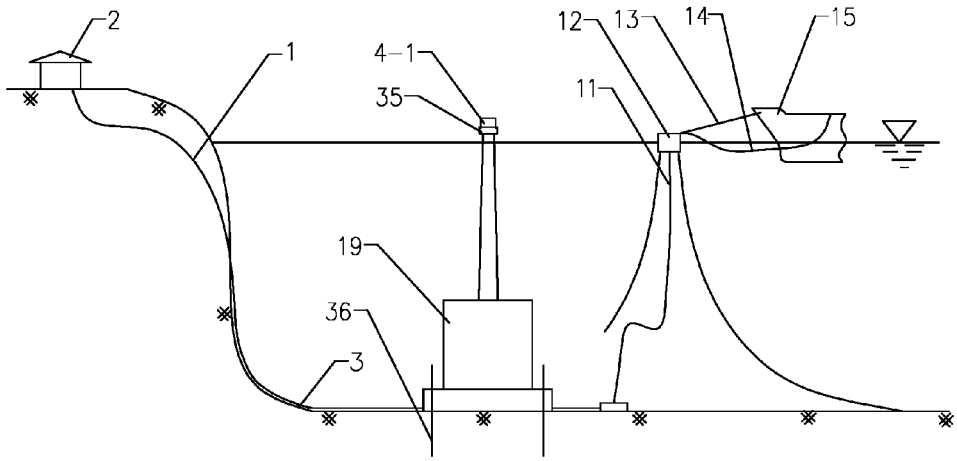
FIG. 16 is an illustration of a liquid storage, loading and offloading system with a bottom-supported and fixed platform near shore.

With reference to FIG. 16, a multi-tank 19 can be fixed on the sea bed by an anti-sliding fixing device 36 and separated from the working station 2 onshore. A traditional pump 4-1, such as a general centrifugal pump or a submerge centrifugal pump, is installed on a flat-top 35, and connected to the working station 2 by the subsea pipeline 3 and the composite cable 1, and to the SPM 12 by the subsea flexible riser 11. The application illustrated in FIG. 16 is preferably used in shallow water area.

The multi-tank 19, which is fixed on the sea bed, still can be floated up and be moved to the next oilfield by releasing the anti-sliding fixing device 36 and evacuating some, or all, stored liquid. The weight control principle of the present embodiment is that: 1) The dry weight shall accord with the requirement of buoyancy and stability during wet tow. 2). The operating weight shall be equal to or larger than the displacement tonnage of the system to guarantee that the system can be stably fixed onto the seabed. 3). When the system is moved for reuse, the total amount of dry weight and weight of left liquid shall be less than the displacement tonnage of the system to ensure its floating ability. In a preferred embodiment, the total operating weight of the multi-tank 19 and attached facilities doesn't need to be very heavy, as long as the operating weight is equal to or larger than the buoyancy, usually between 100~110% of buoyancy. If the bearing capacity of the seabed allows, the negative buoyancy during operation can have no top limit.

2. Loading and Offloading System with Floating Liquid Storage

Figure 17:
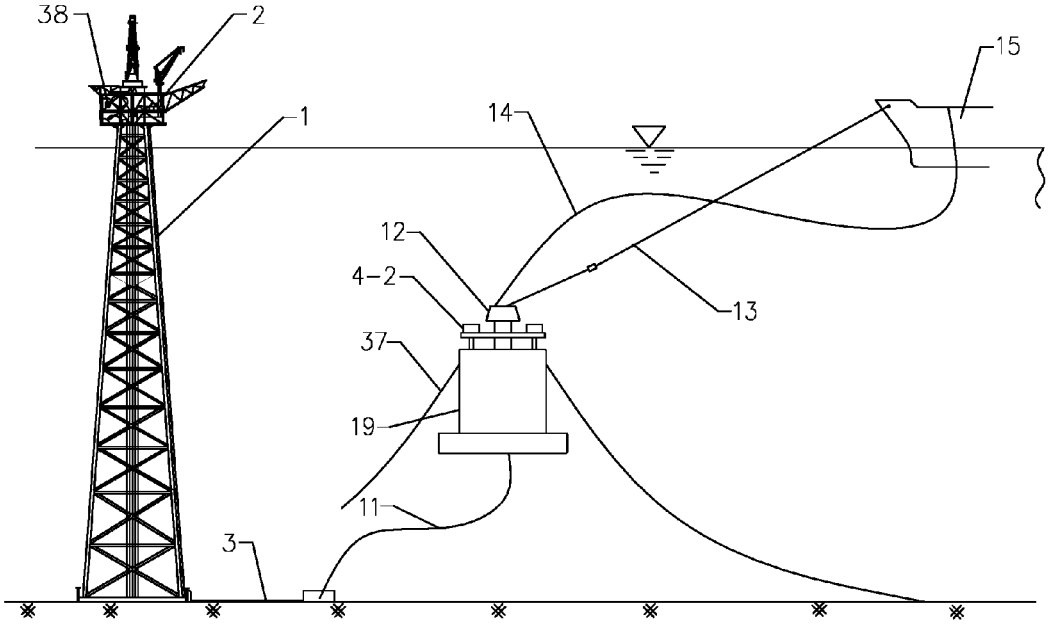
FIG. 17 is an illustration of a liquid storage, loading and offloading system with a bottom-supported and floating platform offshore.
Figure 18:
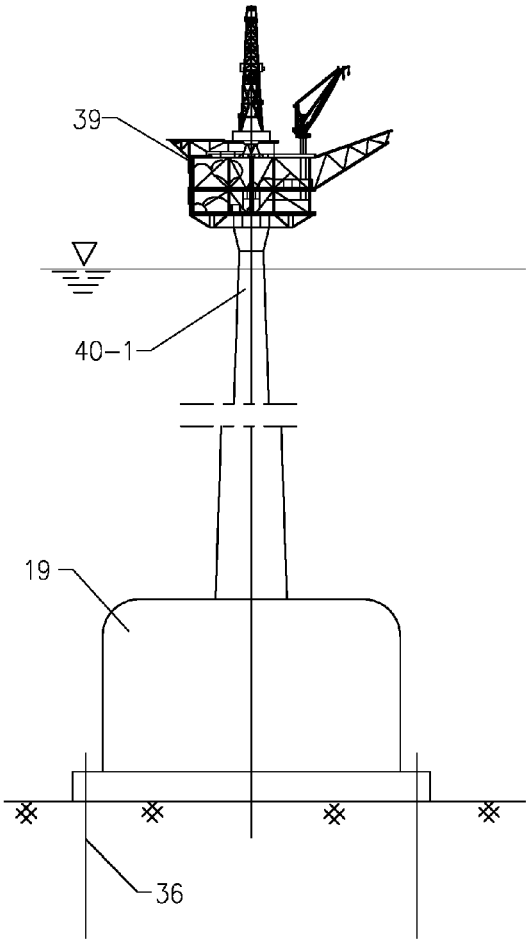
FIG. 18 is a side view of a liquid storage, loading and offloading system with a bottom-supported and fixed platform and a concrete cylinder platform leg.

With reference to FIG. 17, the multi-tank 19 can be in a floating condition and separated from the working station 2. In some embodiments, the working station 2 can be combined with a production facility 38, which can be offshore or onshore. The multi-tank 19 replies on a mooring positioning system 37, which can be, but not limited to, centenary mooring legs or taut/semi-taut positioning system. The gravity and buoyancy of the floating system are dynamically balanced, and the center of gravity is lower than the center of buoyancy. In some embodiments, the SPM 12 and an underwater pump 4-2 can be attached with the multi-tank 19 or the extending structure of the multi-tank 19. Usually, the underwater pump 4-2 is more expensive than the traditional pump 4-1 because it needs to operate in a wet environment, as opposed to a dry environment, in which the traditional pump 4-1 is. The application illustrated in FIG. 17 is preferably used in deep water, where the effect from the wave-induced hydrodynamic load is smaller.

3. Loading and Offloading System with Bottom-Supported and Fixed Platform

With reference to FIGS. 18-22, the multi-tank 19 can be form into a foundation of a bottom-supported and fixed platform. The bottom-supported and fixed platform mainly includes the multi-tank 19, which is fixed on the seabed by an anti-sliding fixing device 36, such as the underwater pile, an apron pile, suction piles, pipe piles, an apron pile with pipe piles, and an apron pile with suction piles. The bottom-supported and fixed platform also has a platform leg, such as a concrete cylinder platform leg 40-1 in FIG. 18, a conventional jacket leg 40-2 in FIG. 19, a compliant tower leg 40-3 in FIG. 20, and a jack-up platform leg 40-4 in FIG. 21. Optionally, the bottom-supported and fixed platform includes a topside facility 39. The depth of water would decide which multi-tank to use. Preferably, A and B-type multi-tank is used with the compliant tower leg in deep water field. The multi-tank with storage cells in form of multiple horizontal bamboo poles is better used in shallow sea. The platform leg contains all pipelines and cables inside and is located between the topside facility 39 and the multi-tank 19. The topside facility 39, which can be a conventional topside applied with a conventional fixed platform, or the topside facility with a watertight bulkhead structure 41 (please referred to FIG. 21) for a jack-up platform, is for oil drilling and production and preferably for electrical power control. The weight control principle of the present embodiment is as same as that of the said loading and offloading system with fixed liquid storage. The bottom-supported and fixed platform still can be floated up and be moved to the next oilfield by releasing the anti-sliding fixing device 36 and evacuating some, or all, stored liquid.

In some embodiment, the platform leg can have its own anti-sliding fixing device, which penetrates the multi-tank, to insert into seabed.

In some embodiment, the solid ballast compartment can be configured to the multi-tank. The selection of the solid ballast compartment depends on the type of the multi-tank.

In some embodiment, the pump module can be installed in the topside facility, the platform leg, or outside of the multi-tank. If installed in the topside facility or the platform leg, the traditional pump is preferred. If installed outside of the multi-tank, the underwater pump is preferred.

In some embodiment, the mooring positioning system 37, such as taut system, can be configured to the multi-tank.

Several construction and offshore installation methods can be used for the bottom-supported and fixed platforms in according to some embodiments, including: 1) the multi-tank, the platform leg and the topside facility are built and towed separately, and offshore installed one after another, such as bottom-supported and fixed platform with the conventional jacket leg; 2) the multi-tank, legs and the topside facility are built in dry dock or onshore, then wet-towed as a whole and offshore installed, such as the bottom-supported and fixed platform with the concrete leg and the jack-up platform leg; 3) the multi-tank, legs and the topside facility are built separately, the multi-tank is offshore installed first, and then legs and the topside facility are assembled on a dry dock, wet-towed as a whole, and finally connected and hooked-up with the multi-tank, such as the bottom-supported and fixed platform with the jack-up platform leg.

4. Loading and Offloading System with Bottom-Supported and Floating Platform

With reference to FIGS. 23-26, the multi-tank 19 can be form into a foundation of a bottom-supported and floating platform. The bottom-supported and floating platform mainly includes the multi-tank 19, which is in a floating condition, a platform leg 42, a topside facility 39, and a mooring positioning system 37. The platform leg 42 is positioned between the topside facility 39 and the multi-tank 19, which is moored by the mooring positioning system 37. The number of the platform leg 42 can be single (please referred to FIG. 23) and multiple (please referred to FIGS. 24-26) and match with different types of the multi-tank. The FIG. 25-1 illustrates a bottom-supported and floating platform with A or B-type SPAR multi-layer multi-tank. The multi-tank 19 is located below the platform leg 42. The FIG. 26-1 illustrate a bottom-supported and floating platform with C-type SPAR multi-layer multi-tank, which only can be combined with multiple platform legs. The mooring positioning system 37 can be centenary mooring legs or taut/semi-taut positioning system. The position to fix the mooring positioning system on the platform depends on conditions of ocean current and wind loading. It can be near the center of buoyancy of the platform or sea surface. While under bad environment, multiple mooring positioning systems can be applied with the platform.

In some embodiments, the solid ballast compartment or ballast materials can be configured to the multi-tank. The selection of the solid ballast compartment depends on the type of the multi-tank. SPAR multi-tank is preferably applied with the implicit bottom solid ballast compartment 20-1 or the implicit lower solid ballast compartment 20-4. The pedestal type of multi-tank is preferably applied with the protruding skirt-shaped bottom solid ballast compartment 20-2 or the protruding skirt-shaped lower solid ballast compartment 20-3.

One of the design goals of the bottom-supported and floating platform is to decrease the loading effect from environment to balance the buoyancy, the stability and the seakeeping performance. To improve the buoyancy, including variable load and displacement of a floating platform and floating conditions, in some embodiment, the additional solid ballast is preferred for balancing extra buoyancy. The symmetry of the multi-tank, the platform leg and the topside facility ensure the center of gravity of the floating platform moves along central axis. In some embodiment, equal mass flow rate displacement system ensures the constant draft depth.

To improve the metacentric height (hereinafter referred as GM) for stability, in some embodiments, the center of buoyancy is above the center of gravity to achieve the effect of self-righting doll by adding at least one solid ballast compartment or ballast materials, or using heavy concrete in lower portion of the multi-tank, and light concrete in upper portion of the multi-tank and the platform leg. In some embodiments, installation of moon pool 30, which has an air can inside and is for risers, and/or conductors extending from underground oil well to the topside facility. The larger tensile force in the riser/conductor is, the larger GM is. In some embodiments, inertial moments of water plane areas of the platforms can contribute some restoring moment, especially for the floating platforms with 3 or 4 legs. The mooring positioning system can also provide some restoring moment for the floating platform, and it will also reduce the tipping of the platforms caused by the current and wind.

Besides, in order to ensure the damage stability while the multi-tank is broken, following methods will be used: first and most important is to prevent the multi-tank being broken by falling objects or impacts close to the water surface. The wall of the multi-tank can be thickened, enhanced, or doubled. For the multi-tanks used for the floating platform, a protecting shield 43 configured to the multi-tank by a upholder 44 (please referred to FIG. 23-1) can be used above the top of the multi-tank, which will not only protect the tank from falling object, but also increase system's damping and additional mass. Second, the multi-tank in tank-in-tank type is used to prevent leakage of stored liquid. Third, watertight bulkhead structure shall be used in the bottom of the topside facility of the floating platform for the last defense. These three methods mentioned above not only ensure stability but also that the floating platform stands straight, while the multi-tank is broken.

To improve the seakeeping performance, reducing wave loads, adjusting the heaving period of the floating platform to improve the motion response and avoid resonance, and increasing the system's damping which is helpful particularly in secondary-order motion's effect are three main approaches.

Regarding reducing wave loads, wave induced force diminishes exponentially with water depth. Although the size of the multi-tanks in according to some embodiment is big, the top of the multi-tank is in the water depth with little effect from wave. Deep-draught of the floating platform is the first method to reduce the effect from wave on the multi-tank. The second method is to reduce the water plane area of the platform legs reasonably. The third method is to reasonably design the elevation configuration of the underwater structure to reduce its dimensions and to avoid larger horizontal wave-induced loads resulting in surge and sway. The platform legs used in the floating platform according to some embodiments are tall and thin cylinder or a cone with smaller diameter and simple configuration. It also can benefit construction at same time. In order to reduce wave loads, the floating platforms according to some embodiments, preferably have 1 or 3 or 4 legs.

Regarding the heaving period of the system, the floating platforms according to some embodiments, belong to the same type as current semi-submersible platform and SPAR, whose heaving period is longer than primary wave period, i.e., 12 to 16 seconds in normal. The heaving (and other degree of freedom) periods of the floating platforms according to some embodiment, are normally longer than 20 seconds. Several measures are taken for longer heaving period of the floating platform, including decreasing the water plane area of the platform leg and using the mooring positioning system. It could reduce the wave loads on column and to control the heaving stiffness, which ideally should not be too big for achieving longer heaving period. However, heaving stiffness can't be too small. It could result in too sensitive responses to the variable loads of the floating platform.

Figure 24:
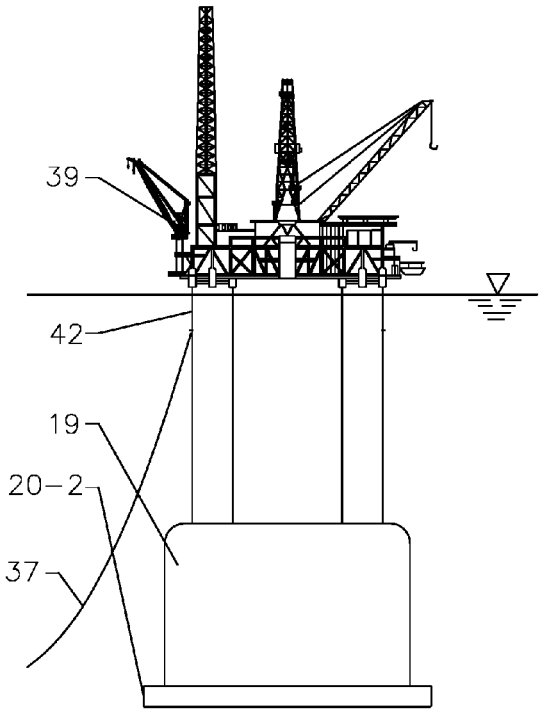
FIG. 24 is a side view of a liquid storage, loading and offloading system with a bottom-supported and floating platform and multiple platform legs.

Regarding increasing the additional mass, system damping and damping moment, in some embodiments, solid ballast compartments or ballast materials could be applied with the floating platform (please referred to the protruding skirt-shaped bottom solid ballast compartment 20-2 in FIG. 24, the implicit lower solid ballast compartment 20-4 in FIG. 25-1, and the implicit bottom solid ballast compartment 20-1 in FIG. 26-1). Among these solid ballast compartments, the protruding skirt-shaped types can increase system's radius of gyration more than implicit types and increase more moment of inertia. In some embodiments, the radius of the multi-tank is designed to increase from top to bottom (please referred to FIG. 14-1). In some embodiment, the protecting shield 43 can increase damping (please referred to FIG. 23-1). The protecting shield 43 preferably has vacancy, which can allow water passing to reduce wave loads. In another embodiment, the damping plate 46 also can increase damping (please referred to FIG. 26-1).

In summary, the contradiction of stability and seakeeping performance of the floating platform needs to balance. The floating platforms of the present invention keep the SPAR's features and advantages, and meanwhile, overcome its drawback, such as no oil storage function.

"Dry and wet" two-step construction can be used for the floating platforms of the present invention: the lower portion of multi-tanks can be constructed at the traditional deep dry dock, then moved to a deep water construction site to finish the construction in a floating condition, and finally wet-towed to the oil field. Offshore installation method is as same as that for semi-submersible and SPAR.

5. Fixed Artificial Island

Figure 27:
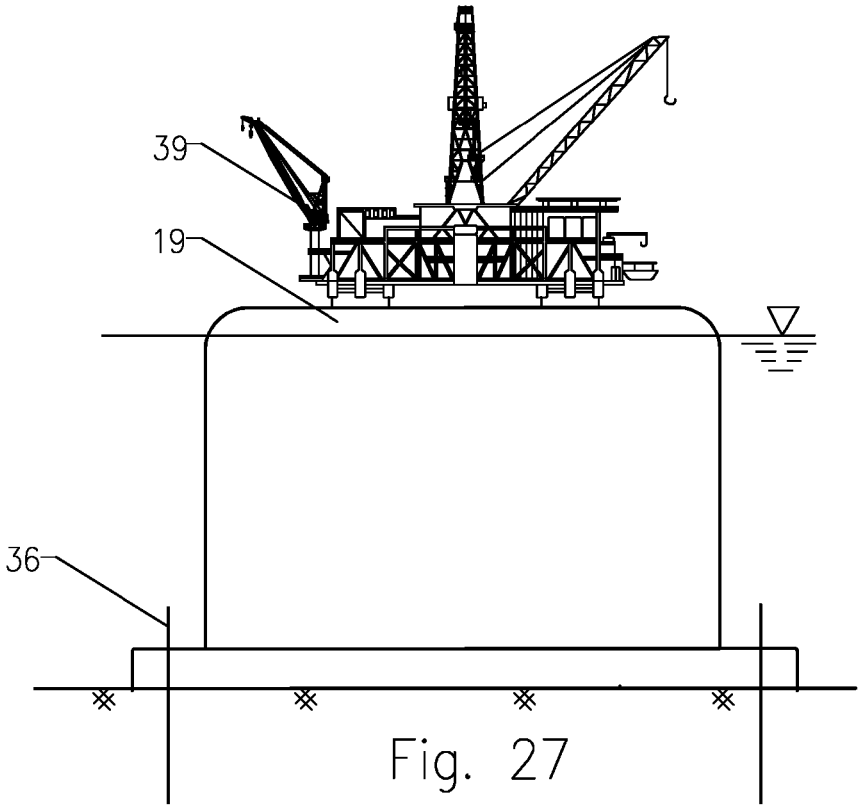
FIG. 27 is a side view of a fixed artificial island.

FIG. 27 illustrates a fixed artificial island including the multi-tank 19, which is formed into a foundation on the seabed and pierces through the water surface, the topside facility 39 is disposed on the multi-tank 19, and the anti-sliding fixing device 36, such as an apron pile, suction piles, pipe piles, an apron pile with pipe piles and an apron pile with suction piles, to fix the multi-tank 19 on seabed. Except for SPAR multi-layer multi-tank, other types of multi-tank mentioned above can be used in the fixed artificial island.

In a preferred embodiment, weight control of the fixed artificial island of the present invention shall follow the following principles. First, the operating weight of fully loaded fixed artificial island shall be a little bit more than or equal to its buoyancy at the high tidal level. Second, after the liquids inside the island drained up (still some residue remained), the light operating weight of island shall be less than its buoyancy. The first principle ensures that the problem of the operating weight less than buoyancy, which will result in the uplifting force on the foundation, won't happen. The second principle will ensure the island has possibility of re-floating during removing and reuse.

In some embodiments, since the fixed artificial island has large water plane area, the island's buoyancy changes significantly as the tidal level changes to cause adverse effects on the foundation. In order to balance the changes on buoyancy caused by draft, compensation system can be added in the fixed artificial island. The compensation system can add or reduce ballast seawater automatically according to the changes of the tidal level during the equivalent mass flow-rate replacement between seawater ballast and stored liquid.

6. Floating Artificial Island

Figure 28:
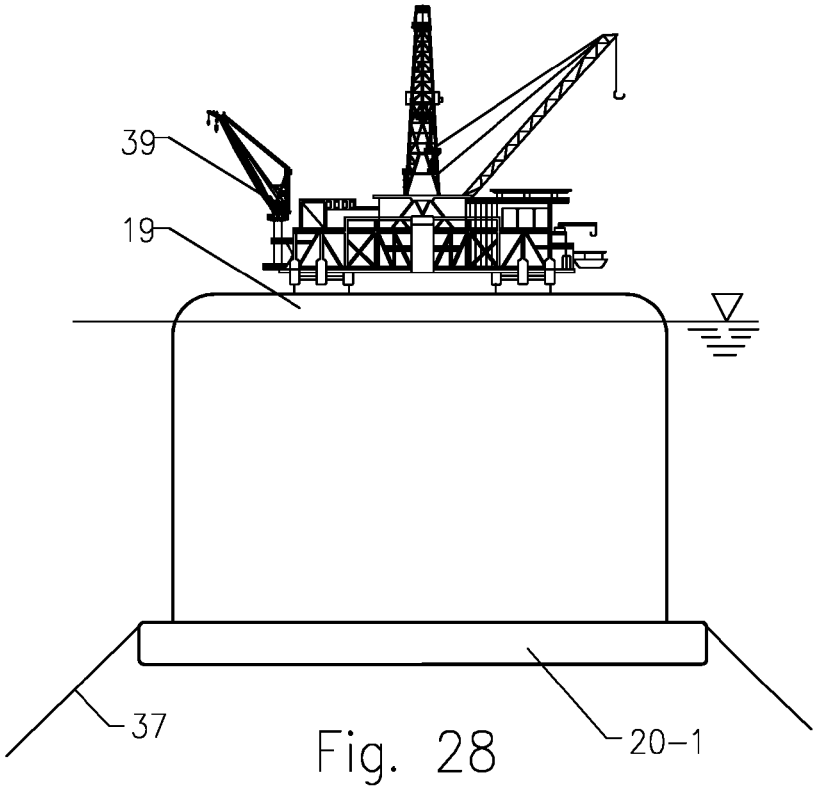
FIG. 28 is a side view of a floating artificial island.

FIG. 28 illustrates a floating artificial island including the multi-tank 19 to form into a foundation in a floating condition and pierces through the water surface, the topside facility 39 on the multi-tank 19, and the mooring positioning system 37 to moor the multi-tank 19 on seabed. Except for SPAR multi-layer multi-tank and the multi-tank only for fixed systems, other types of multi-tank mentioned above can be used in the floating artificial island.

The stability of the floating artificial island will mainly rely on the moment of inertia generated by its own large water plane area since its center of gravity is above its center of buoyancy. Large water plane area causes higher heave stiffness, which will decrease the heave natural period to be closer to primary wave period, and thus produce resonance.

In some embodiments, the floating artificial island of the present invention can preferably rely on the protruding skirt-shaped bottom solid ballast compartment 20-2 (please referred to FIG. 28), the protruding skirt-shaped lower solid ballast compartment, or the wheel-shaped solid ballast compartment to act as a damping plate for improving the hydrodynamic performance in harsh seas. The solid ballast compartment can be filled with seawater or other ballast materials.

The floating artificial island of the present invention looks similar to SSP platform but actually differs from SSP platform in three ways. First, some embodiments have solid ballast compartment, as a damping plate, preferably the skirt-shaped and the wheel-shaped solid ballast compartment. Second, the structure of island body is different, especially the design of the multi-tank. Third, some embodiment has the loading and offloading system with equal mass flow rate displacement as mentioned above, which will ensure the island's draft remains unchanged during operation.

There are different ways to construct and install the island. For instance, build the whole island (including both island-body and topsides facilities) in "dry" way, and then wet-tow to the oilfield for offshore installation. For another instance, build the island-body in "dry" way or in "dry" & "wet" two-step and build topsides facilities separately, wet-tow the island-body and transport topsides facility to the oilfield respectively, and finally complete offshore installation and hook-up. For another instance, install the topsides facilities on island-body in deepwater site, and then wet-tow them as a whole to oilfield for offshore installation. Both the fixed and floating artificial island is movable and relocatable.

The bottom-supported and fixed platforms, the bottom-supported and floating platforms, the fixed artificial island, and the floating artificial island in according to some embodiments maintain and carry forward the advantages of current fixed and floating platforms like jacket-type, jack-up-type, concrete gravity-type fixed platforms and SPAR, SEMI floating platforms, and meanwhile, overcome their disadvantages. The present invention solves the problems, including underwater oil storage, heating, and reuse. The bottom-supported and fixed platforms in some embodiments of the present invention can be used for oil and gas development in both shallow waters and harsh deep waters. It is well known that current FPSO with storage function is hard to fit drilling and dry-well due to limited hydrodynamic performance. However, the current floating platforms with good hydrodynamic performance to fit drilling and dry-well like SPAR are without storage function. The bottom-supported and floating platforms according to some embodiments of the present invention have the advantages of both FPSO and SPAR and are suitable for oil and gas development in both shallow/calm and harsh/deep waters. The artificial island according to some embodiments of the present invention has large water plane area, so it has relatively bigger wave loads. Therefore, the fixed artificial island is preferably used in calmer and shallow waters. As to the floating artificial island, because of the damping effect caused by the protruding skirt-shaped structures (20-2, 20-3, 20-5), it has very good hydrodynamic performance, and can be used in harsh and deep waters. The platforms and artificial islands, which match with a SPM or a spread mooring system for a shuttle tanker, can have the full-function of drilling, production, storage and export. Besides, the fixed artificial island can be also used as the key component of offshore quay to berth shuttle tankers alongside directly.

In summary, the bottom-supported and fixed platforms, the bottom-supported and floating platforms, the fixed artificial island, and the floating artificial platforms all have following advantageous: simple system and structure, easy to construct, short construction period, low capital, operation and maintenance costs, good anti-corrosive performance, long service life of the structure, no waste or emission of the oil gas during loading and offloading, no pollution, and flexible installation and relocation for reuse. They are suitable for not only large-sized oil and gas fields with long production life, but also small-sized oil and gas fields with short production life, especially for marginal oil and gas fields.

The present invention has been described in terms of specific embodiments incorporating details to facilitate the understanding of principles of construction and operation of the invention. Such reference herein to specific embodiments and details thereof is not intended to limit the scope of the claims appended hereto. It will be readily apparent to one skilled in the art that other various modifications may be made in the embodiment chosen for illustration without departing from the spirit and scope of the invention as defined by the claims.

What claims is:

1. A liquid storage, loading and offloading system comprising:

a storage tank comprising at least one water ballast compartment to store a water and at least one liquid storage compartment to store a liquid;

a volume of inert gas disposed in upper ends of the water ballast compartment and the liquid storage compartment;

wherein the upper ends of the water ballast compartment and the liquid storage compartment are fluidly coupled to each other to form a pressurized closed interconnected system; and wherein the structure of the storage tank is configured symmetrically.

2. The liquid storage, loading and offloading system according to claim 1 further comprising a valve connected to the water ballast compartment and to the liquid storage compartment; wherein the valve opens under a first condition and therefore the water ballast compartment and the liquid storage compartment become a pressurized-equalized closed interconnected system; and wherein the valve closes under a second condition and therefore the water ballast compartment and the liquid storage compartment become two separate systems not fluidly connected.

3. The liquid storage, loading and offloading system according to claim 1 further comprising a pump module coupled to the storage tank; wherein the pump module comprising at least one pair of loading pumps and at least one pair of offloading pumps; wherein the pair of loading pumps including a liquid loading pump to load the liquid into the liquid storage compartment and a water offloading pump to offload the water out of the water ballast compartment; and wherein the pair of offloading pumps including a water loading pump to load the water into the water ballast compartment and a liquid offloading pump to offload the liquid out of the liquid storage compartment.

4. The liquid storage, loading and offloading system according to claim 3 further comprising an equal mass flow rate displacement system to keep a constant operating weight such that the pair of loading pumps operate substantially at equal mass flow rate to displace the water with the liquid; and also such that the pair of offloading pumps operate substantially at equal mass flow rate to displace the liquid with the water.

5. The liquid storage, loading and offloading system according to claim 3 wherein the water offloading pump or the liquid offloading pump is replaced by a pressure energy of the inert gas in the water ballast compartment or the liquid storage compartment such that the pressure energy offloads the water or the liquid out.

6. The liquid storage, loading and offloading system according to claim 3 further comprising a converting valve coupled to the pump module for converting offloaded liquid to a different location.

7. The liquid storage, loading, and offloading system according to claim 1 further comprising a shuttle tank to receive an offloaded liquid from the storage tank or transmitting the liquid to the storage tank; and wherein the shuttle tank is coupled to the storage tank by a riser.

8. The liquid storage, loading and offloading system according to claim 1 further comprising a working station for providing power and control; and wherein the working station is coupled to the storage tank by a cable.

9. The liquid storage, loading and offloading system according to claim 1 further comprising a hydrocarbon production facility coupled to the storage tank by a pipeline.

10. The liquid storage, loading and offloading system according to claim 1 further comprising a fixing device attached to the storage tank for fixing the storage tank on a seabed and wherein an operating weight of the system is equal to or larger than a buoyancy of the system.

11. The liquid storage, loading and offloading system according to claim 1 further comprising a mooring positioning system attached to the storage tank for mooring the storage tank on a seabed in a floating condition.

12. The liquid storage, loading and offloading system according to claim 1 further comprising a solid ballast disposed adjacent to the storage tank to increase weights and damping and lower a center of gravity; and wherein a diameter of the solid ballast is equal to or larger than the diameter of the storage tank.

13. The liquid storage, loading and offloading system according to claim 1 wherein the liquid storage compartment is located inside of the water ballast compartment to form a tank-in-tank type of construction; wherein the liquid storage compartment and the water ballast compartment share a central axis; and wherein if a plurality of storage tanks exist, the plurality of storage tanks are arranged in symmetry and the plurality of storage tanks as a whole share the same central axis.

14. The liquid storage, loading and offloading system according to claim 1 wherein the liquid storage compartment is adjacent to the water ballast compartment, either horizontally or vertically, to form a not tank-in-tank type of the storage tank; wherein if a plurality of storage tanks exist, the plurality of storage tanks are arranged in symmetry and positioned apart from one another or positioned head-to-tail vertically or horizontally; and wherein a vertically positioned lower storage tank has a higher pressure of inert gas inside, than a vertically positioned higher storage tank.

15. The liquid storage, loading and offloading system according to claim 14 wherein if a plurality of water ballast compartments or liquid storage compartments exist, the plurality of water ballast compartments or liquid storage compartments are interconnected by a conduit respectively to become one water ballast compartment or one liquid storage compartment in substance.

16. The liquid storage, loading and offloading system according to claim 1 wherein the inert gas is nitrogen.

17. The liquid storage, loading and offloading system according to claim 1 wherein the storage tank is formed as a foundation of a bottom-supported platform.

18. The liquid storage, loading and offloading system according to claim 17 further comprising a topside facility to produce hydrocarbon, and a platform leg; wherein the platform leg is attached to the top of the storage tank; wherein the topside facility is connected to the platform leg; and wherein the hydrocarbon generated by the topside facility is stored directly in the storage tank.

19. The liquid storage, loading and offloading system according to claim 18 further comprises a moon pool for a riser or a conductor extending from an underground oil well to the topside facility.

20. The liquid storage, loading and offloading system according to claim 18 further comprising a fixing device to fix the bottom-supported platform on a seabed to form a bottom-supported and fixed platform; wherein a weight of the bottom-supported and fixed platform at a high water level is equal to or larger than a buoyancy of the bottom-supported and fixed platform, and therefore no heavy weight of the bottom-supported and fixed platform is required for stability; and wherein while the liquid inside the bottom-supported and fixed platform is drained, the weight of the bottom-supported and fixed platform is lighter than the buoyancy to help remove and relocate the platform.

21. The liquid storage, loading and offloading system according to claim 20 wherein the bottom-supported and fixed platform is sufficiently tall to pierce the water surface or near the water surface, and becomes a fixed artificial island.

22. The liquid storage, loading and offloading system according to claim 18 further comprising a mooring positioning system to moor the bottom-supported platform on the seabed in a floating condition to form a bottom-supported and floating platform; wherein a center of gravity of bottom-supported and floating platform is lower than a center of buoyancy of the bottom-supported and floating platform; and wherein a heaving period of the bottom-supported and floating platform is equal to or larger than 20 seconds to keep a constant operating weight.

23. The liquid storage, loading and offloading system according to claim 22 wherein the bottom-supported and floating platform is sufficiently tall to pierce the water surface or near the water surface, and becomes a floating artificial island.

24. The loading and offloading system according to claim 22 further comprising a protecting shield disposed above the storage tank to protect any impact from an outside environment and to increase weights and damping.

25. The liquid storage, loading, and offloading system according to claim 1 wherein the quantity of the inert gas is fixed.

26. A process of a loading and offloading system with equal mass flow rate displacement system comprising:

transporting a stored liquid or water from a bottom of a liquid storage compartment or a water ballast compartment to an inlet of a liquid offloading pump or a water offloading pump by a pressure energy of an inert gas;

offloading the stored liquid or water by the respective offloading pump or only by the pressure energy of the inert gas;

supplying the inert gas to maintain pressure of the inert gas of the liquid storage compartment or the water ballast compartment;

and wherein the supplied inert gas is from the water ballast compartment which is loaded with water at the same mass flow rate as the offloaded liquid, or from the liquid storage compartment which is loaded with liquid at the same mass flow rate as the offloaded water.

27. A liquid storage, loading and offloading system comprising:

an artificial island comprising at least one water ballast compartment to store a water and at least one liquid storage compartment to store a liquid inside;

a topside facility disposed above the artificial island to produce hydrocarbon;

a volume of inert gas disposed in upper ends of the water ballast compartment and the liquid storage compartment; and wherein the upper ends of the water ballast compartment and the liquid storage compartment are fluidly coupled to each other to form a pressurized closed interconnected system; and wherein the hydrocarbon generated by the topside facility is stored directly in the artificial island.

28. The liquid storage, loading and offloading system according to claim 27 wherein the structure of the artificial island is configured symmetrically.

29. The liquid storage, loading and offloading system according to claim 27 further comprising a valve connected to the water ballast compartment and to the liquid storage compartment; wherein the valve opens under a first condition and therefore the water ballast compartment and the liquid storage compartment become a pressurized-equalized closed interconnected system; and wherein the valve closes under a second condition and therefore the water ballast compartment and the liquid storage compartment become two separate systems not fluidly connected.

30. The liquid storage, loading and offloading system according to claim 27 further comprising a pump module coupled to the artificial island; wherein the pump module comprising at least one pair of loading pumps and at least one pair of offloading pumps; wherein the pair of loading pumps including a liquid loading pmnp to load the liquid into the liquid storage compartment and a water offloading pump to offload the water out of the water ballast compartment; and wherein the pair of offloading pumps including a water loading pump to load the water into the water ballast compartment and a liquid offloading pump to offload the liquid out of the liquid storage compartment.

31. The liquid storage, loading and offloading system according to claim 30 further comprising an equal mass flow rate displacement system to keep a constant operating weight such that the pair of loading pumps operate substantially at equal mass flow rate to displace the water with the liquid; and also such that the pair of offloading pumps operate substantially at equal mass flow rate to displace the liquid with the water.

32. The liquid storage, loading and offloading system according to claim 27 further comprising a fixing device to fix the artificial island on a seabed to form a fixed artificial island; wherein a weight of the fixed artificial island at a high water level is equal to or larger than a buoyancy of the artificial fixed island; and wherein while the liquid inside the artificial fixed island is drained, the weight of the artificial island is lighter than the buoyancy to help remove and relocate the artificial island.

33. The liquid storage, loading and offloading system according to claim 27 further comprising a mooring positioning system to moor the artificial island on a seabed in a floating condition to form a floating artificial island.

34. The liquid storage, loading and offloading system according to claim 27 further comprising a solid ballast disposed adjacent to the artificial island to increase clamping and to improve a hydrodynamic performance; and wherein a diameter of the solid ballast is equal to or larger than a diameter of the storage tank.

35. The liquid storage, loading and offloading system according to claim 34 wherein the solid ballast is selected from the group consisting of a protruding skirt-shaped bottom solid ballast compartment, a protruding skirt-shaped lower solid ballast compartment, and a wheel-shaped solid ballast compartment.

36. A liquid storage, loading, and offloading system comprising:

a storage tank comprising at least one water ballast compartment to store a water and at least one liquid storage compartment to store a liquid;

a volume of inert gas;

wherein the water ballast compartment and the liquid storage compartment are fluidly coupled to each other to form a closed interconnected system;

wherein the structure of the storage tank is configured symmetrically;

a pair of loading pumps for offloading the water out of the water ballast compartment and loading the liquid into the liquid storage compartment operating substantially at equal mass flow rate to displace the water with the liquid;

a pair of offloading pumps for loading the water into the water ballast compartment and offloading the liquid out of the liquid storage compartment operating substantially at equal mass flow rate to displace the liquid with the water; and wherein an operating weight of the system is kept substantially constant.

* * * * *